US006926172B2

(12) United States Patent
Jaworski et al.

(10) Patent No.: US 6,926,172 B2
(45) Date of Patent: Aug. 9, 2005

(54) TOTAL RELEASE DISPENSING VALVE

(75) Inventors: Thomas Jaworski, Racine, WI (US); Nathan R. Westphal, Racine, WI (US); Donald J. Shanklin, Corona, CA (US); David J. Houser, Racine, WI (US); Tor H. Petterson, deceased, late of Rancho Palos Verdes, CA (US); by Grace C. Petterson, legal representative, Rancho Palos Verdes, CA (US)

(73) Assignee: S. C. Johnson & Son, Inc., Racine, WI (US)

( * ) Notice: Subject to any disclaimer, the term of this patent is extended or adjusted under 35 U.S.C. 154(b) by 54 days.

(21) Appl. No.: 10/236,364

(22) Filed: Sep. 6, 2002

(65) Prior Publication Data

US 2003/0080144 A1 May 1, 2003

Related U.S. Application Data

(63) Continuation-in-part of application No. 10/056,349, filed on Jan. 24, 2002, now Pat. No. 6,478,199, and a continuation-in-part of application No. 10/056,873, filed on Jan. 24, 2002, now Pat. No. 6,688,492, and a continuation-in-part of application No. 10/010,319, filed on Nov. 13, 2001, now Pat. No. 6,612,464, and a continuation-in-part of application No. 10/002,657, filed on Oct. 31, 2001, now Pat. No. 6,533,141, and a continuation-in-part of application No. 10/002,664, filed on Oct. 31, 2001, now Pat. No. 6,588,627.

(51) Int. Cl.[7] ..... B65D 83/14

(52) U.S. Cl. ..... 222/153.12; 222/402.13; 222/402.14; 222/649

(58) Field of Search ..... 222/153.12, 402.13, 222/402.14, 635, 649

(56) References Cited

U.S. PATENT DOCUMENTS

| | | | |
|---|---|---|---|
| 3,305,134 A | 2/1967 | Carmichael et al. | |
| 3,477,613 A | 11/1969 | Mangel | |

(Continued)

FOREIGN PATENT DOCUMENTS

| | | | |
|---|---|---|---|
| EP | 826608 A1 | 3/1998 | |
| FR | 1 497 250 | 10/1967 | |
| JP | 56 037070 | 4/1981 | |
| JP | 56 044060 | 4/1981 | |
| JP | 56 044061 | 4/1981 | |
| JP | 56 044062 | 4/1981 | |
| JP | 56 070865 | 6/1981 | |
| JP | 57 174173 | 10/1982 | |
| JP | 3-85170 | 4/1991 | ..... B65D/83/14 |
| JP | 03 085169 | 4/1991 | |
| JP | 10216577 | 8/1998 | ..... B05B/9/04 |
| JP | 2001048254 | 2/2001 | ..... B65D/83/40 |

OTHER PUBLICATIONS

Patent Abstracts of Japan vol. 015, No. 256 (C–0845), Jun. 28, 1991 & JP 03 085170 A (Showa Seiki KK), Apr. 10, 1991 abstract—Spray Amount Control Mechanism of Automatic Jet Apparatus.

*Primary Examiner*—Joseph A. Kaufman

(57) ABSTRACT

A valve assembly can automatically and essentially totally release aerosol content from an aerosol container in a single burst without the use of electric power or constant manual activation. A diaphragm at least partially defines an accumulation chamber that receives aerosol chemical from the can during an accumulation phase. Once the internal pressure of the accumulation chamber reaches a predetermined threshold, the diaphragm moves, carrying with it a seal so as to unseal an outlet channel, and thereby initiate a spray of the main active chemical. The diaphragm is held in the open position while there is elevated pressure of active in the can and/or due to a latch that activates as the diaphragm moves to the dispensing position.

21 Claims, 22 Drawing Sheets

U.S. PATENT DOCUMENTS

| | | | | | |
|---|---|---|---|---|---|
| 3,497,108 | A | | 2/1970 | Mason | 222/61 |
| 3,542,248 | A | | 11/1970 | Mangel | 222/70 |
| 3,658,209 | A | | 4/1972 | Freeman et al. | |
| 3,664,548 | A | | 5/1972 | Broderick | |
| 3,968,905 | A | * | 7/1976 | Pelton | 222/649 |
| 4,077,542 | A | | 3/1978 | Petterson | |
| 4,396,152 | A | | 8/1983 | Abplanalp | |
| 5,018,963 | A | | 5/1991 | Diederich | |
| 5,025,962 | A | | 6/1991 | Renfro | |
| 5,702,036 | A | | 12/1997 | Ferrara | 222/402.13 |
| 5,791,524 | A | | 8/1998 | Demarest | |
| 6,216,925 | B1 | | 4/2001 | Garon | 222/645 |

* cited by examiner

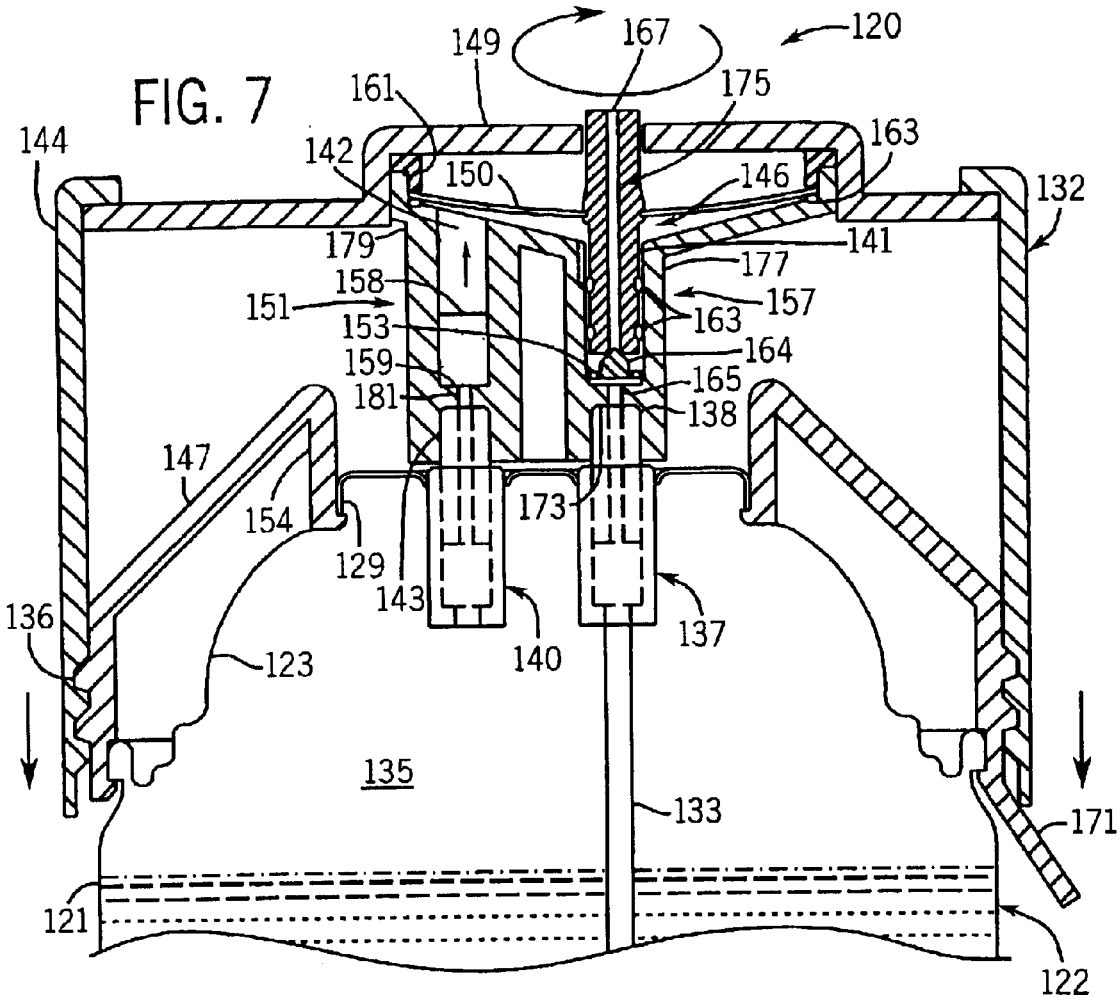
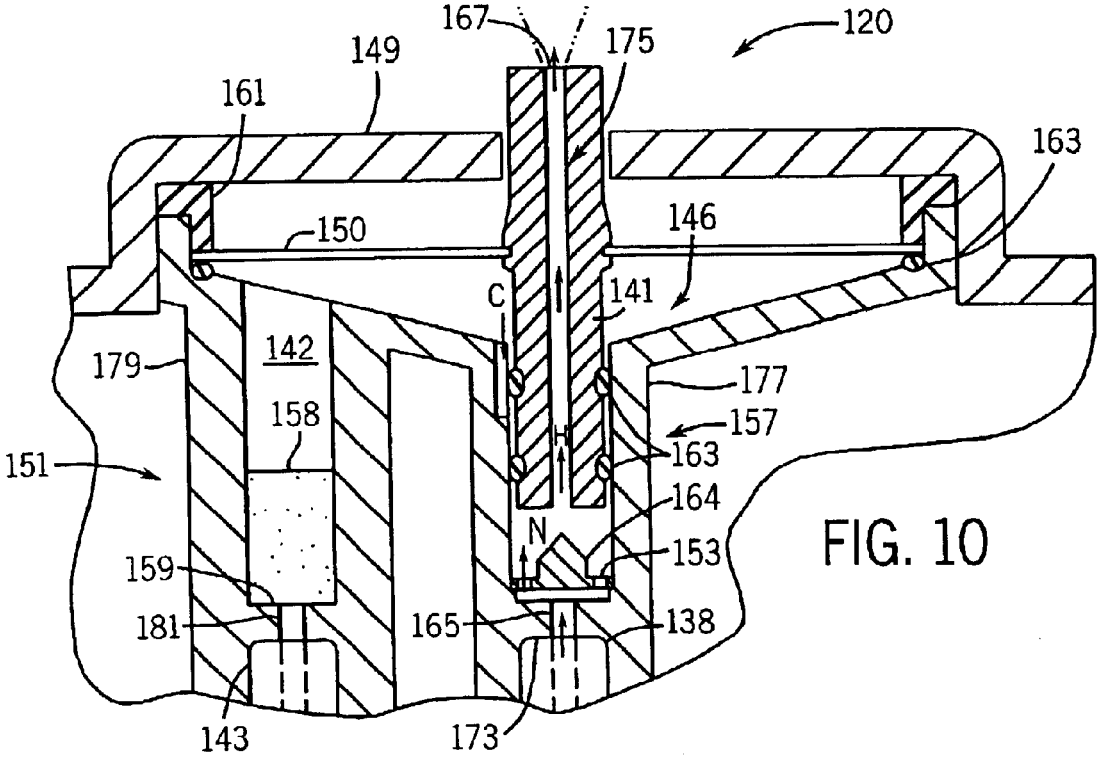
FIG. 10

TOTAL RELEASE DISPENSING VALVE

CROSS-REFERENCE TO RELATED APPLICATIONS

This application is a continuation-in-part of the following patent applications, each of which is hereby incorporated by reference as if set forth in their entirety herein: U.S. Ser. No. 10/002,664 filed Oct. 31, 2001 now U.S. Pat. No. 6,588,627; U.S. Ser. No. 10/002,657 filed Oct. 31, 2001 now U.S. Pat. No. 6,533,141; U.S. Ser. No. 10/010,319 filed Nov. 13, 2001 now U.S. Pat. No. 6,612,464; U.S. Ser. No. 10/056,349 filed Jan. 24, 2002 now U.S. Pat. No. 6,478,199; and U.S. Ser. No. 10/056,873 filed Jan. 24, 2002 now U.S. Pat. No. 6,688,492.

STATEMENT REGARDING FEDERALLY SPONSORED RESEARCH/DEVELOPMENT

Not applicable

BACKGROUND OF THE INVENTION

The present invention relates to aerosol dispensing devices, and in particular to valve assemblies that provide the automatic release of aerosol content in a single burst without requiring the use of electrical power.

Aerosol cans dispense a variety of ingredients. Typically, an active is mixed with a propellant which inside the can is at least partially in a gas state, but may also be at least partially dissolved into a liquid containing active. Typical propellants are a propane/butane mix or carbon dioxide. The mixture is stored under pressure in the aerosol can.

The active mixture is then sprayed by pushing down/sideways on an activator button at the top of the can that controls a release valve. For purposes of this application, the term "active chemical" is used to mean that portion of the content of the container (regardless of whether in emulsion state, single phase, or multiple phase), which is in liquid phase in the container (regardless of phase outside the container) and has a desired active such as an insect control agent (repellent or insecticide or growth regulator), fragrance, sanitizer, and/or deodorizer alone and/or mixed in a solvent, and/or mixed with a portion of the propellant.

Pressure on a valve control button is typically supplied by finger pressure. However, for fragrances, deodorizers, insecticides, and certain other actives which are sprayed directly into the air, it is sometimes desirable to empty the entire contents of the aerosol container at once. While this can be done manually, applying constant finger pressure until the container is empty is tiring and impractical. Furthermore, when delivering an insect repellant or fumigant to an area, it would typically be desirable for the user to be located elsewhere while the active chemical is being delivered.

Prior art systems exist for automatically distributing the entire active content of an aerosol container in one burst. The user depresses the trigger on the aerosol content to lock the trigger in the dispense position. See e.g. U.S. Pat. No. 5,791,524. However, aerosol content begins flowing the moment that the trigger is depressed, thereby having a period of time in which the person activating the dispensing is proximate the dispensed chemical. Such systems have limitations, particularly where the chemical being dispensed is an insecticidal fumigant.

Thus, a need still exists for improved, inexpensive automated aerosol dispensers that do not require electrical power, provide a single burst of the active chemical that essentially exhausts the contents of the supply, and do so with a time delay after initial activation.

BRIEF SUMMARY OF THE INVENTION

In one aspect the invention provides a valve assembly that is suitable to dispense an active chemical from an aerosol container. The assembly is of the type that can automatically release active chemical from the container.

There is a housing mountable on an aerosol container. A movable diaphragm is associated with the housing and linked to a seal, the diaphragm being biased towards a first configuration. An accumulation chamber is inside the housing for receiving chemical from the container and providing variable pressure against the diaphragm. A passageway is suitable for linking the linking the aerosol container with an outlet of the valve assembly.

When the diaphragm is in the first configuration the seal restricts the flow of the active chemical out of the valve assembly via the passageway. When the pressure inside the accumulation chamber exceeds a specified threshold the diaphragm can move to a second configuration where active chemical is permitted to spray from the valve assembly. Once the diaphragm has moved from the first configuration to the second configuration it will automatically stay out of the first configuration until at least a majority of the active chemical in the container has been released.

In preferred forms a porous material is disposed within the passageway to regulate the flow rate of gas propellant there through.

While the diaphragm does not shift back to the first configuration from the second configuration if pressure of the gas propellant in the accumulation chamber falls below a threshold amount, in another preferred form a latch is linked to the diaphragm that engages when the diaphragm is in the second configuration to further inhibit the seal from moving back to a position blocking the passageway.

In another form the seal is displaceable in an axial direction and the valve assembly includes a second passageway linking the container with the accumulation chamber. The second passageway delivers gas propellant from the container to the accumulation chamber. There may also be an actuator portion of the housing that rotates to allow gas propellant to leave the container and enter the second passageway.

The dispensers are designed for use with a wide variety of active chemicals. Preferred examples are insect repellents, insecticides, fragrances, sanitizers and deodorizers.

Methods for using these valve assemblies with aerosol containers are also disclosed.

The present invention achieves a secure mounting of a valve assembly on an aerosol can, yet provides an actuator that has two modes. In one mode the valve assembly is operationally disconnected from the actuator valve of the aerosol container (a mode suitable for shipment or long-term storage). Another mode operationally links the valve assembly to the aerosol container interior, and allows a user to automatically begin the total release of chemical there from. Importantly, a the dispensing of aerosol content lags behind the operational linking of the valve assembly to the aerosol container interior to allow the user to leave the area before aerosol content is dispensed.

The foregoing and other advantages of the invention will appear from the following description. In the description reference is made to the accompanying drawings which form a part thereof, and in which there is shown by way of illustration, and not limitation, preferred embodiments of the invention. Such embodiments do not necessarily represent the full scope of the invention, and reference should therefore be made to the claims herein for interpreting the scope of the invention.

BRIEF DESCRIPTION OF THE DRAWINGS

FIG. 7 is a sectional view of an automatic dispensing valve assembly of another embodiment, in an "off" configuration;

FIG. 10 is a view similar to FIG. 9, but with the valve in the spray phase of the dispensing cycle;

DETAILED DESCRIPTION OF THE PREFERRED EMBODIMENT

Figure 1:
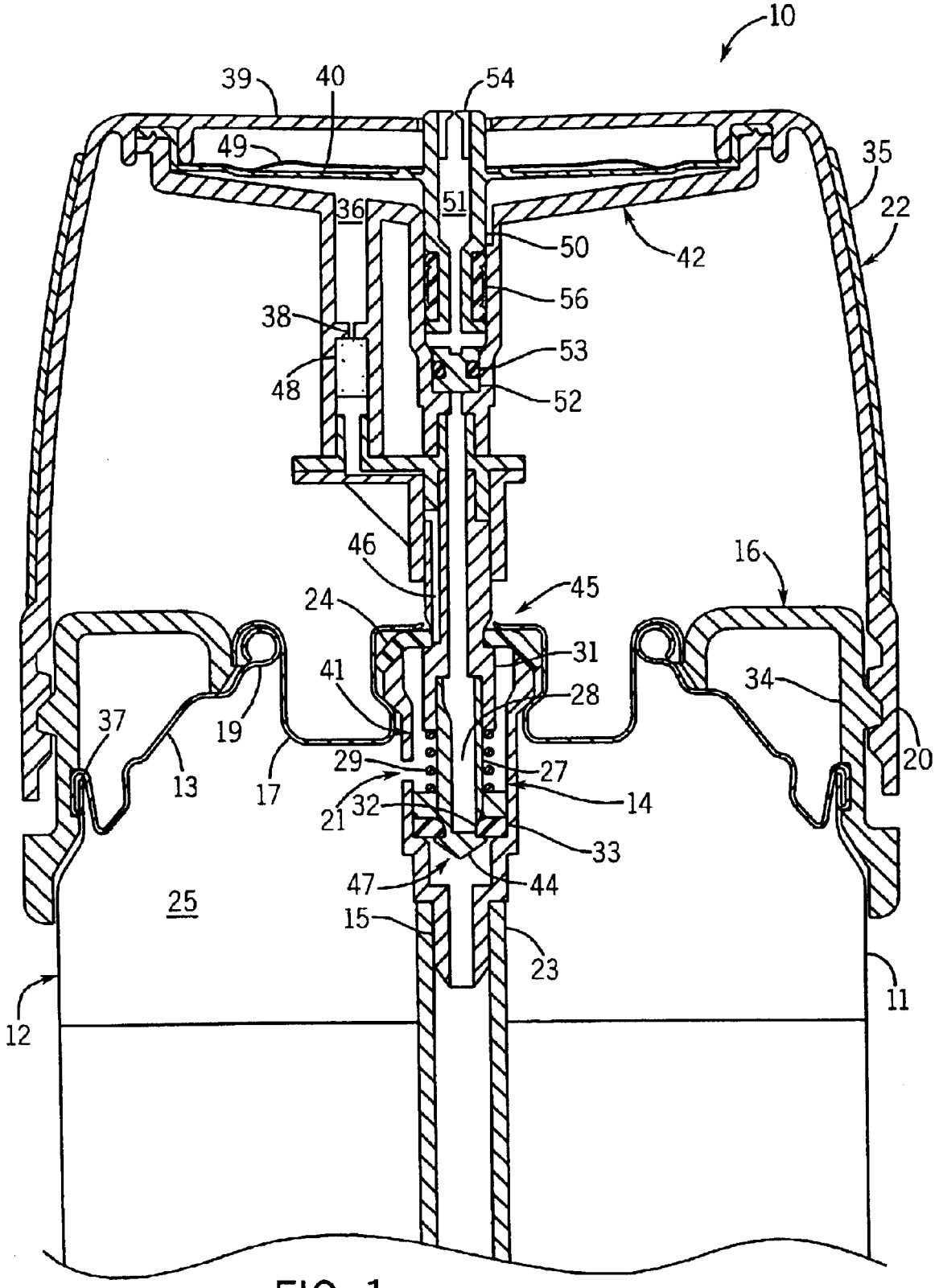
FIG. 1 is a schematic sectional view of a first preferred automated dispensing valve assembly of the present invention, in an off configuration, mounted on an aerosol can.

Referring initially to FIG. 1, an aerosol can 12 includes a cylindrical wall 11 that is closed at its upper margin by a dome 13. The upper margin of the can wall 11 is joined at a can chime 37. An upwardly open cup 17 is located at the center of the dome 13 and is joined to the dome by a rim 19.

The can 12 includes an axially extending conduit 23 that is centrally disposed therein, and opens into a mixed pressurized chemical (active and gas propellant) at one end (preferably towards the bottom of the can). The upper region 25 of the can interior above the active chemical line contains pressurized gas propellant. The lower region contains a mix of liquid gas and the active chemical. The upper end of conduit 23 receives a tee 15 that interfaces with the interior of dispenser 10, through which the chemical may be expelled.

Dispenser 10 includes a can valve assembly 45 that, in turn, includes a gas propellant valve assembly 41 and an active valve assembly 47. Dispenser 10 permits aerosol content to be automatically released into the ambient environment in a single burst. Dispenser 10 is mostly polypropylene, albeit other suitable materials can be used.

A mounting structure 16 is snap-fit to the valve cup rim 19 at its radially inner end, and to the can chime 37 at its radially outer end. The radially outer wall 34 of mounting structure 16 extends axially, and is threaded at its radially outer surface. The dispenser 10 has a radially outer wall 35 that includes a lower skirt portion 20 which forms part of a control assembly 22. Skirt 20 has threads disposed on its radially inner surface that intermesh with threads on outer wall 34 to rotatably connect the dispenser 10 to the aerosol can 12. The axially outer end of wall 35 terminates at a radially extending cover having a centrally disposed outlet that contains a dispensing nozzle 54 which enables active to be sprayed out the dispenser 10 at predetermined intervals. In operation, the dispenser 10 may be switched "ON" and "OFF" by rotating member 22 relative to the can 12, as will be apparent from the description below.

It should be appreciated that throughout this description, the terms "axially outer, axially downstream, axially inner, axially upstream" are used with reference to the longitudinal axis of the container. The term "radial" refers to a direction outward or inward from that axis.

Figure 2:
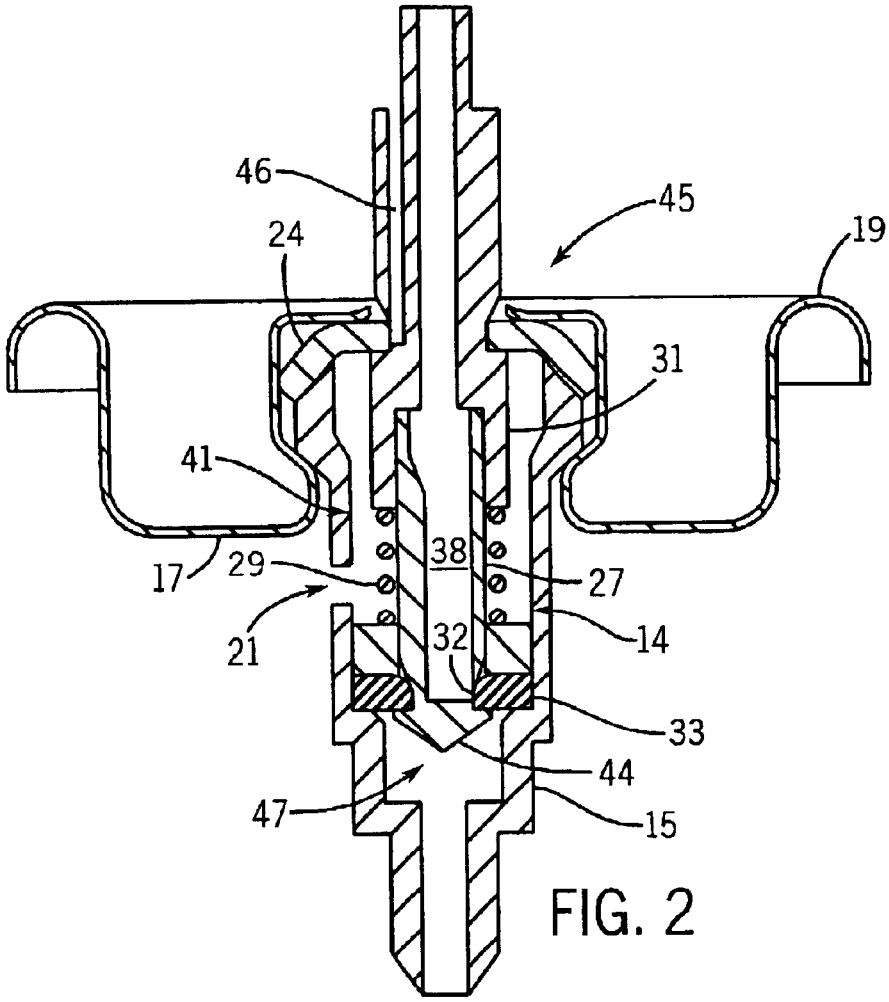
FIG. 2 is an enlarged view of a can outlet valve portion of the dispensing valve assembly of FIG. 1.

Referring also to FIG. 2, the tee 15 defines an interior cavity 14 disposed axially downstream from conduit 23. Tee 15 is sized so as be to crimped within the center of the open end of cup 17. An elongated annular wall 27 defines a first conduit 28 that extends axially from the interior of cavity 14 and centrally through the dispenser 10 to deliver the active mixture from the can 12 the dispensing nozzle 54. An elongated valve stem 31 extends axially downstream from wall 27 into the dispenser 10, and enables thus enables conduit 28 to extend into the dispenser.

Tee 15 further defines a passageway 21 extending between cavity 14 and gaseous collection portion 25. Passageway provides a propellant intake channel, as will become more apparent from the description below. A propellant delivery channel 46 extends axially through conduit 31, and connects cavity 14 with an accumulation chamber 36 that receives propellant. The internal pressure of accumulation chamber 36 determines when the dispenser 10 is in an accumulation phase (e.g. when the system has first been activated by the user), and when a release mode begins and continues until the can contents are essentially exhausted.

Valve stem 31 exerts pressure against gasket 33 via a spring member 29. Wall 27 provides a plunger that extends axially upstream from the axially inner end of valve stem 31, and terminates at a seal 44 that is biased against the gasket 33. When the dispenser is "OFF," (See FIG. 2) the spring force biases seal 44 against the gasket 33, thereby preventing active from flowing into channel 28. Furthermore, valve stem 31 is biased against a gasket 24 proximal the outer end of can 12 to provide a seal there between, thus preventing the flow of propellant from can 12 into passageway 46. Accordingly, neither gas propellant nor active mixture is permitted to flow from the can 12 into the dispenser at this time. The dispenser 10 is thus in a storage/shipment position.

A channel 32 extends through the surface of wall 27 proximal the seal 44 to enable the active to flow into the dispenser 10 when the dispenser is in an "ON" configuration.

Figure 3:
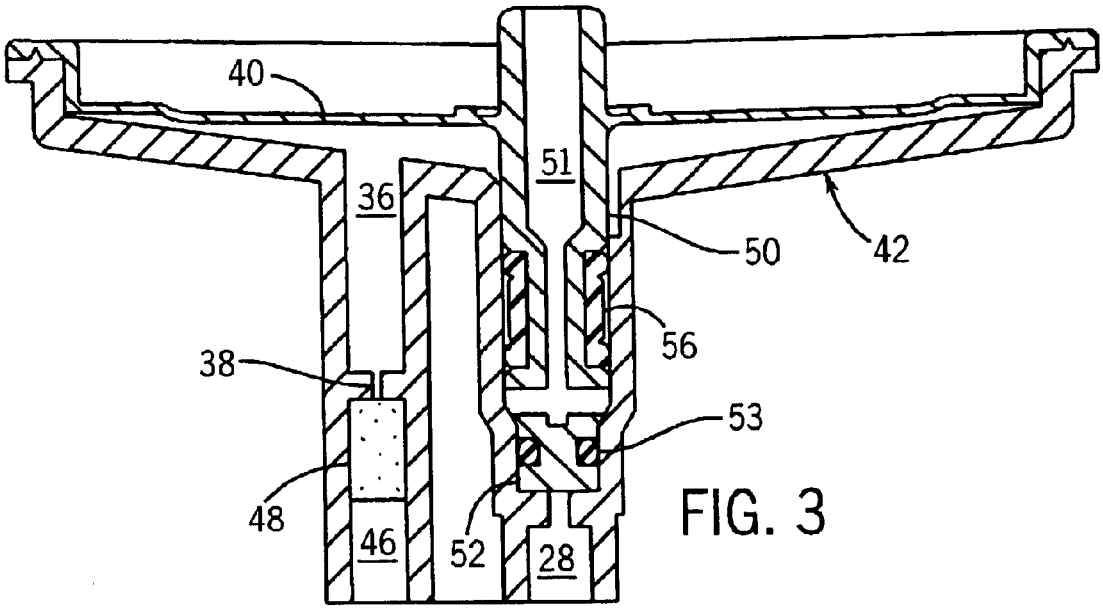
FIG. 3 is an enlarged view of a dispensing portion of the dispensing valve assembly of FIG. 1.

Referring now also to FIG. 3, the axially outer end of valve stem 31 terminates at a centrally disposed inlet to a retainer wall 42 that, in turn, connects to an axially extending annular conduit 50. Conduit 50 extends outwardly to nozzle 54, and provides an outlet channel 51 to deliver active to the ambient environment. A plug 52 is disposed at the inner end of channel 51, and is sealed by an o-ring 53 to prevent pressurized active from flowing out the dispenser 10 when the dispenser is not in a "SPRAY" phase, as will be described in more detail below.

Conduit 46 extends radially outwardly proximal the junction between conduits 50 and 31, and opens at its axially outer end into a propellant inlet 38 of retainer wall 42. An accumulation chamber 36 is defined by a retainer wall 42 that, in combination with a flexible, mono-stable diaphragm 40, encases the accumulation chamber 36. Diaphragm 40 comprises an annular plate that is supported at its radially outer surface by an annular spring member 49 that biases the diaphragm 40 towards the closed position illustrated in FIG. 1.

Figure 4:
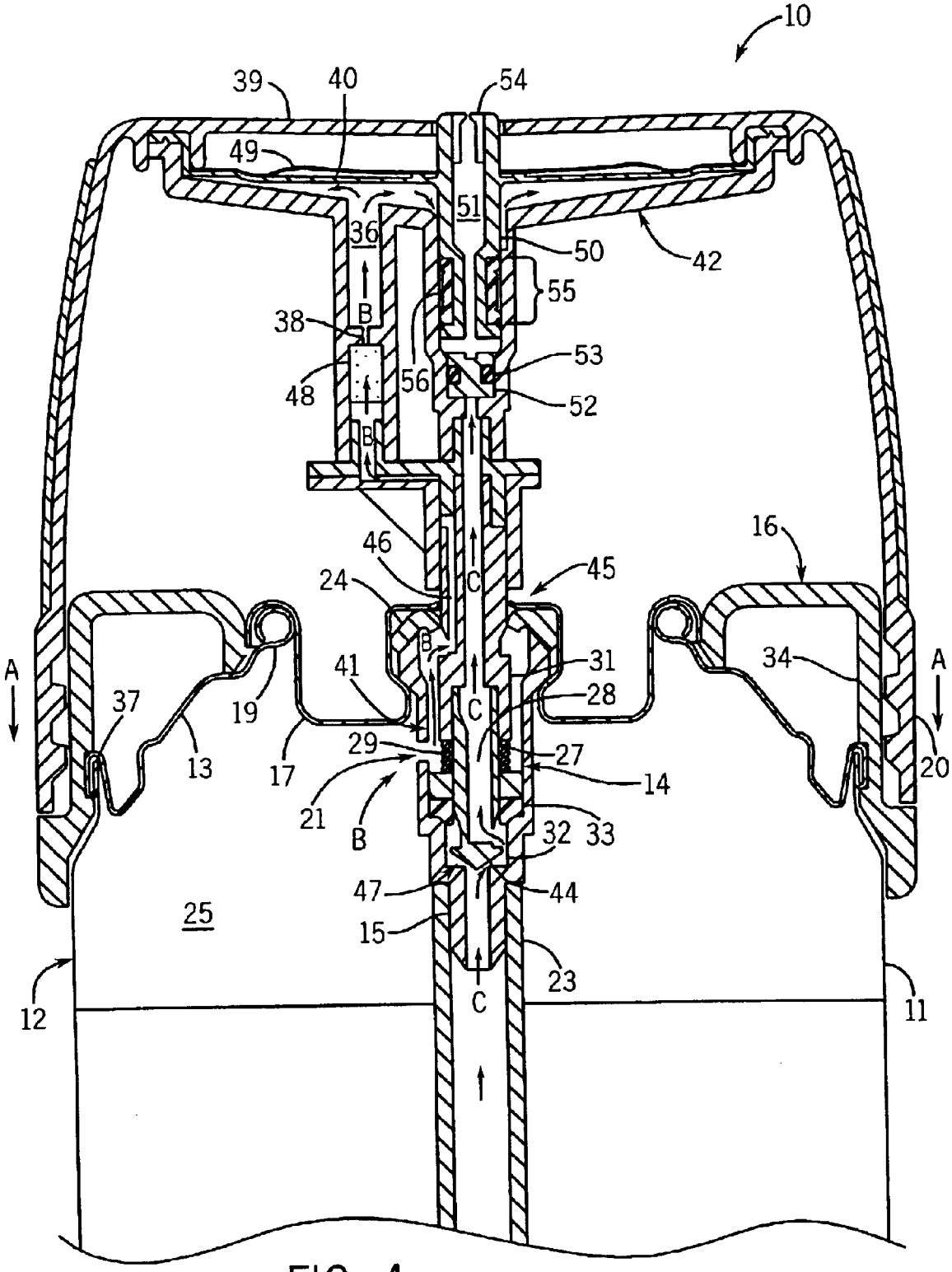
FIG. 4 is a view similar to FIG. 1, but with the device shown in the on configuration during an accumulation phase.
Figure 5:
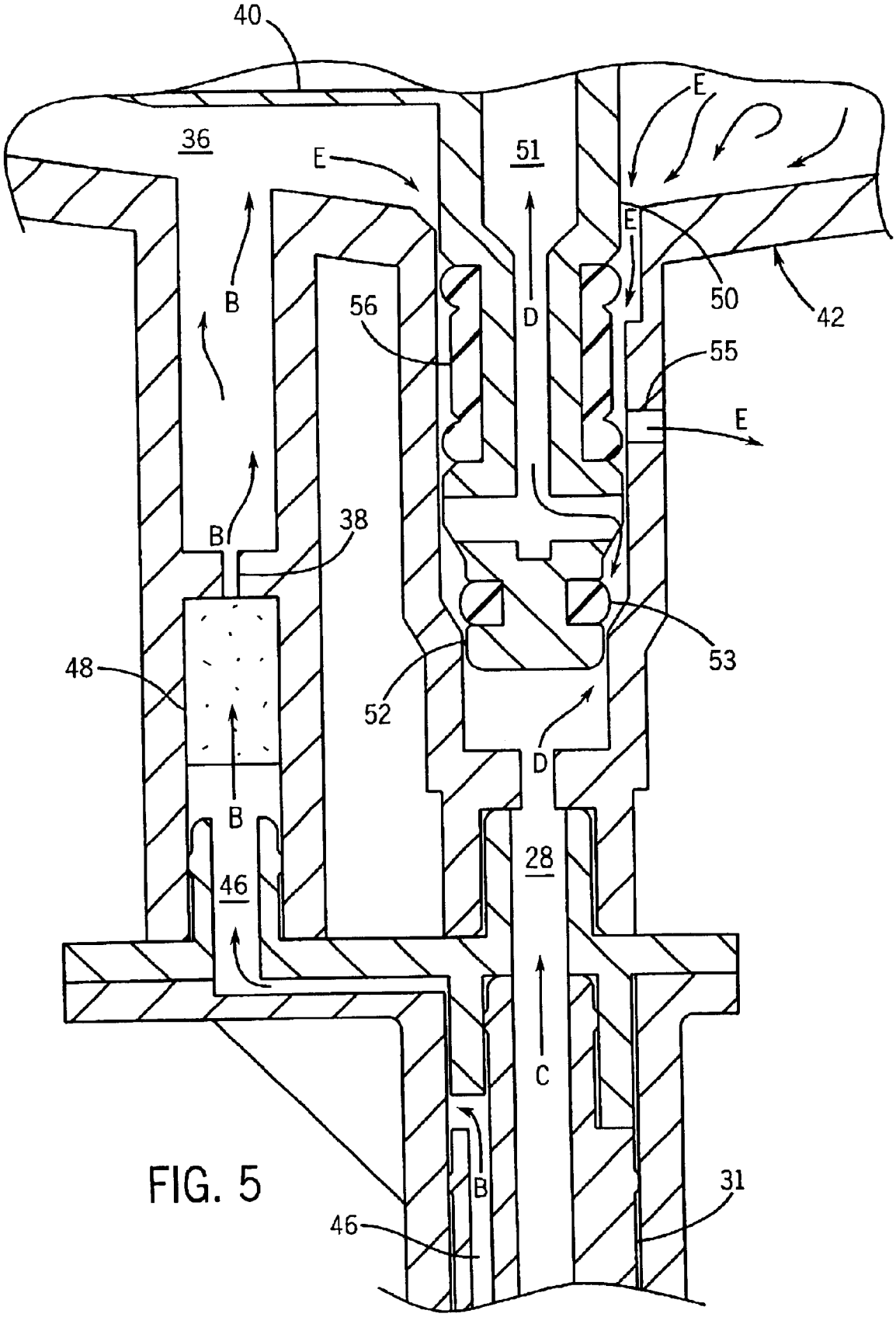
FIG. 5 is an enlarged view of a portion of the FIG. 1 device, but with the device shown in a spray phase.

The diaphragm 40 is movable from the first accumulation position (FIG. 4) to a second open position (FIG. 5) to present the dispenser 10 in a "spray" configuration. A porous media 48, which is preferably made of a low porosity ceramic or any other similarly permeable material, is disposed in inlet 38 to accumulation chamber 36 to regulate the flow rate of entering gas propellant, thus increasing the amount of time between when the dispenser 10 is turned on and when active is sprayed. The radially outer edge of diaphragm 40, at its axially outer end, extends into a groove formed on the radially inner surface of cover 39. The radially inner edge of diaphragm is integrally connected to conduit 50.

An elongated sleeve 56 extends axially between wall 50 and the axially extending portion of retainer wall 42, and includes two outer pairs of sealing rings 55 at its distal ends that form a fluid-tight seal with the inner surface of retainer wall 42, as will be described in more detail below.

Referring again to FIG. 4, the dispenser is turned "ON" by rotating the control assembly 22 to displace the dispenser 10 axially inwardly along the direction of arrow A. It should be appreciated that the compliance of spring 29 minimizes the risk of damage to the dispenser 10 due to over-rotation by the user. Also, there is a shoulder feature on the element 16 to act as an additional stop. The valve stem 31 is displaced downward, thereby compressing spring 29 to displace the seal 44 axially upstream and away from gasket 33. The displacement of valve stem 31 furthermore removes the seal 24.

An accumulation phase is thereby initiated, in which the pressurized gas propellant flows from the can 12 downstream along the direction of arrow B through cavity 14 and into channel 46. The propellant then travels into the inlet 38 of accumulation chamber 36, where it is regulated by porous flow control media 42 before flowing into the accumulation chamber.

Once the control assembly 22 has been rotated to turn the dispenser 10 "ON," pressurized active mixture is also able to exit the can 12. In particular, the active flows through conduit 23, and around the seal 44 into channel 21, where it continues to travel along the direction of Arrow C towards outlet channel 51. However, because plug 52 is disposed at the mouth of channel 51, the active is unable to travel any further downstream at this point.

However, the constant supply of gas propellant flowing from intake channel 46 into the accumulation chamber 36 causes pressure to build therein, and such pressure acts against the radially inner surface of diaphragm 40. Once the accumulation chamber 36 is sufficiently charged with gas propellant, such that the pressure reaches a predetermined threshold, the mono-stable diaphragm 40 becomes deformed from the normal closed position illustrated in FIG. 4 to the open position illustrated in FIG. 5.

This initiates a spray phase, during which the diaphragm 40 causes conduit 50 to become displaced axially outwardly. As conduit 50 becomes displaced outwardly, plug 52 becomes removed from channel 28. Accordingly, because the inner diameter of retainer wall 42 increases as plug 52 travels downstream, the active mixture is permitted to travel from conduit 28, around the plug, and into outlet channel 51 along the direction of Arrow D. The pressurized active then travels from channel 51 and out the nozzle 54 as a continuous spray. It should be appreciated that the seal between the both annular rings 55 of sleeve 56 and the inner surface of retainer wall 42 is maintained during both the accumulation phase and spray phase, thereby preventing propellant from exiting the accumulation chamber 36.

Because propellant is unable to easily escape from the accumulation chamber 36 during the spray phase, the chamber tends to remain pressurized above the threshold needed to maintain the spray phase. If some propellant happens to leak past sleeve 56, propellant from the upper region 25 of can 12 will replace the leaked propellant to maintain the internal pressure of accumulation chamber 36 above the minimum threshold. Accordingly, once the diaphragm 40 is displaced to initiate the spray phase, active chemical will continue to be expelled from the can 12 until the can is essentially exhausted.

The duration of the accumulation phase may be controlled, for example, by adjusting the stiffness of diaphragm 40, the internal volume of chamber 36, and/or the porosity of porous flow media 48.

It should be appreciated that the dispenser 10 and can 12 may be sold to an end user as a pre-assembled unit. In operation, the user rotates the assembly 22 to displace the valve assembly 45 axially inwardly, thereby causing the aerosol contents to flow out of can 12, and beginning the accumulation cycle. The gas propellant flows through conduit 46 and into the accumulation chamber 36. Once the spray phase is initiated, the active mixture flows through conduit 51, and exits the nozzle 54 into the ambient environment until all active chemical is totally released from the can 12.

Advantageously, when it is desired to emit a fumigant or insecticide, a user is able to initiate the accumulation phase and subsequently vacate the area to be fumigated prior to initiation of the spray phase. Accordingly, a user is able to position the nozzle 54 where desired and manually begin the dispensing cycle. Due to the time delay before spraying starts the consumer may leave the room before spraying. This may be particularly desirable when the active chemical is a fumigant such as an insecticide.

Note also that only one brief manual activation step is required. The consumer need not continuously apply finger pressure to achieve continued spraying.

Figure 6:
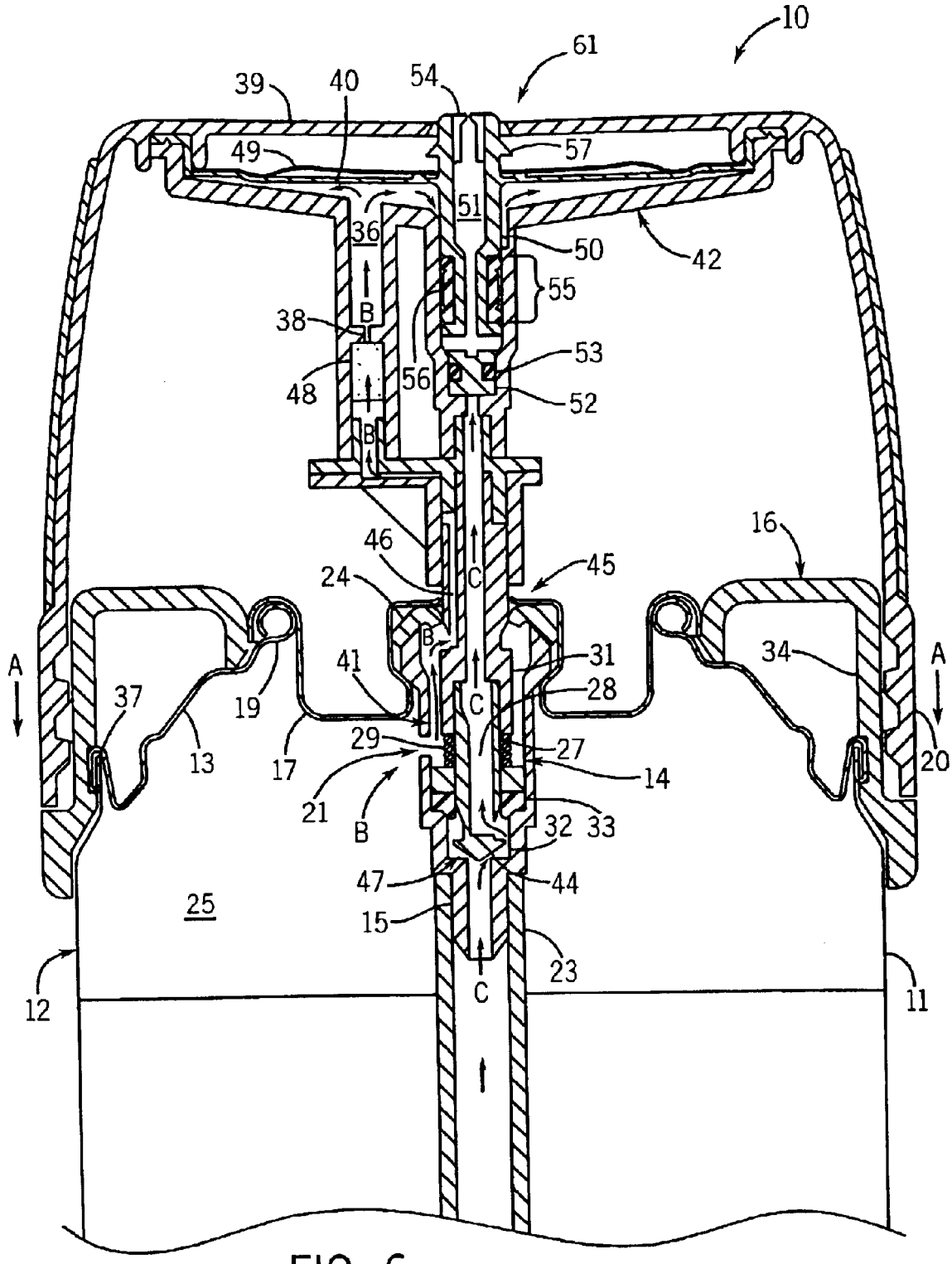
FIG. 6 is a view similar to FIG. 4 of an alternate embodiment.
Figure 8:
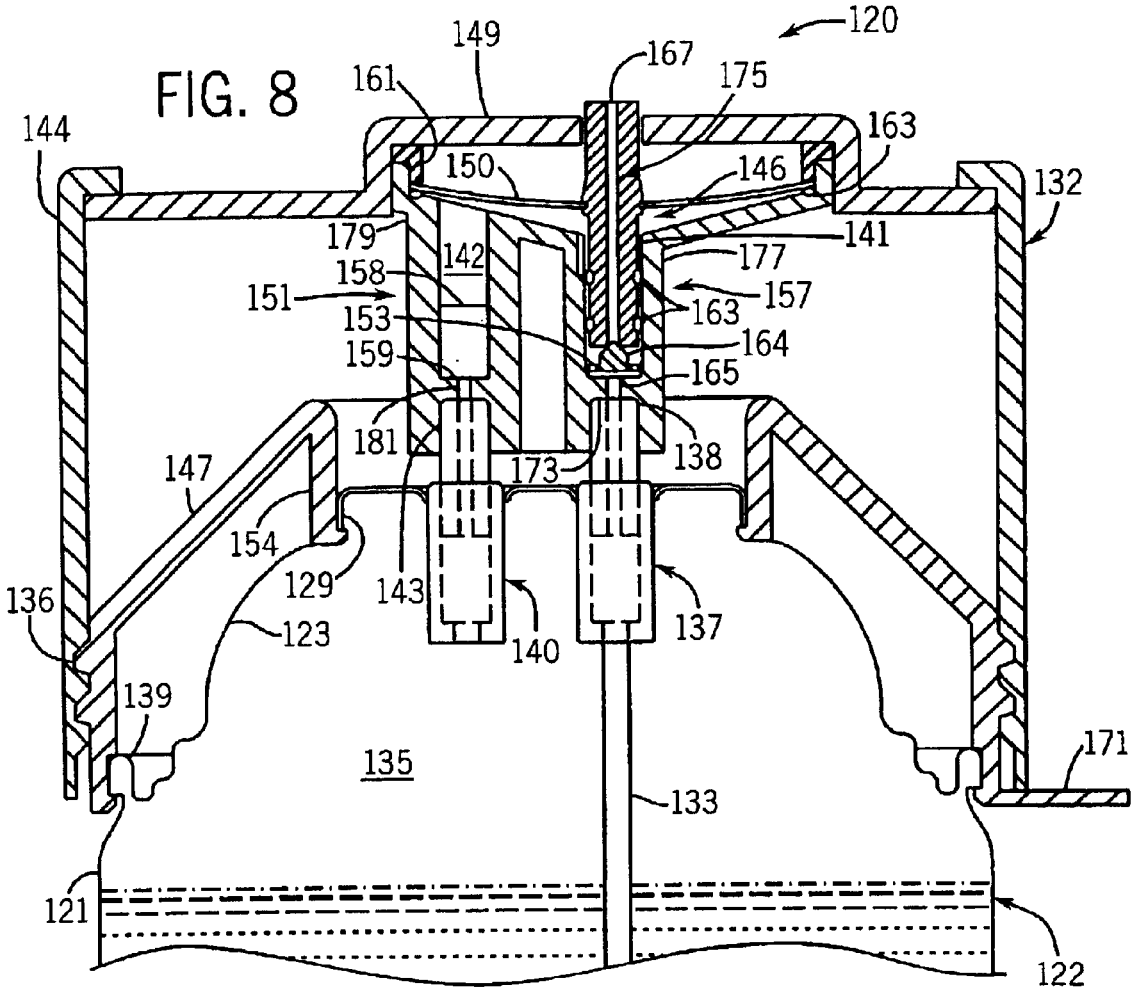
FIG. 8 is a view similar to FIG. 7, but with the valve in an "on" configuration during the accumulation phase of the dispensing cycle.

Referring now to FIG. 6, dispenser 10 could be modified to also include a mechanical latching/locking mechanism 61 to help retain the dispenser 10 in the spray configuration. This can be achieved with one or more barbs 57 that protrude radially outwardly from conduit 50 at a position slightly axially inwardly with respect to cover 39. The radially inner edge of cover 39 adjacent the nozzle 54 is beveled, such that cover will cam over the barb(s) 57 and lock conduit 50 into place when the dispenser 10 assumes the spray configuration.

As a result, once the pressure within accumulation chamber 36 reaches the predetermined threshold, and conduit 50 is displaced outwardly, the interface between barbs 57 and cover 39 will lock the dispenser 10 in the spray configuration, regardless of whether the pressure within accumulation chamber subsequently falls below the threshold. The locking mechanism is thus positioned such that, when engaged, the plug 52 is sufficiently displaced from conduit 28 to enable active chemical to flow freely out the dispenser 10.

Referring next to FIGS. 7–10, a dispenser 120 in accordance with another embodiment is mounted onto can 122 via outer wall 144 that has a threaded inner surface so as to intermesh with threads on the outer surface of wall 136. A cover 149 extends substantially radially inwardly from the axially outer end of wall 144. Wall 136 has a flange at its axially inner surface that engages can chime 139. Wall 136 is integrally connected to an angled wall 147 that extends radially inwardly, and axially downstream, there from. Wall 147 is integrally connected at its radially inner edge to wall 154 that extends axially upstream and has a flange that engages rim 129.

Control assembly 120 further includes a lever 171 that is rotated along with wall 144 to displace the control assembly 132 in the axial direction, as described above. Additionally, lever 171 could include a perforated tab (not shown) between itself and wall 144 that is broken before the dispenser can be actuated, thereby providing means for indicating whether the dispenser has been tampered with.

Can 122 includes first and second valves 137 and 140, respectively, that extend into can 122. Valve 137 is connected to a conduit 133 that extends axially towards the bottom of the can so as to receive the chemical mixture. Valve 140 terminates in the upper region 135 of can 122 so as to receive gaseous propellant. Valves 137 and 140 include downwardly actuatable conduits 138 and 143, respectively, that extend axially out of the can 122. Accordingly, dispenser 120 may be provided as a separate part that is mountable onto can 122 by rotating wall 144 with respect to wall 136.

Figure 9:
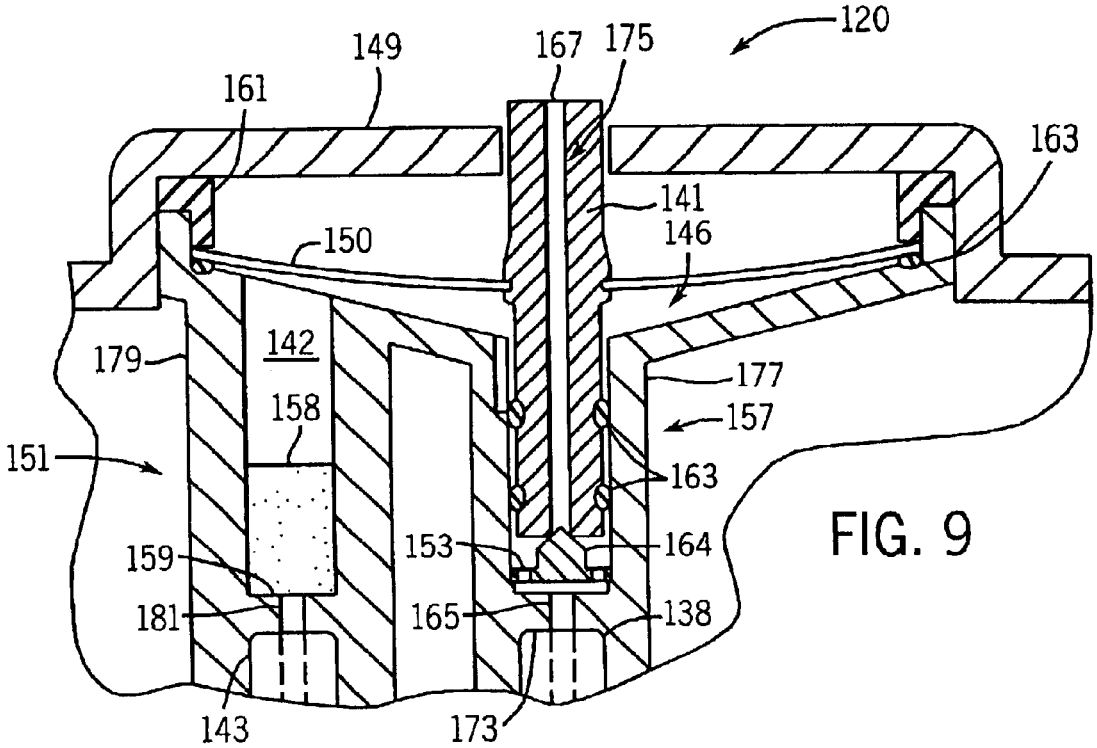
FIG. 9 is an enlarged view of a part of the valve assembly of FIG. 7.

Referring next to FIG. 9, active valve assembly 157 includes an annular wall 177 whose axially inner end slides over conduit 137. A flange 173 extends radially inwardly from wall 177, and engages the outer end of conduit 138. Flange 173 defines a centrally disposed channel 165 that extends axially there through and aligned with conduit 138. An annular wall 141 fits inside wall 177 and extends axially downstream from flange 173, and defines an axially extending conduit 175 that is in fluid communication with channel 165. Channel 165 extends out the dispenser 120 to provide an outlet 167 to the ambient environment.

A plug 164 is disposed between channels 175 and 165, and blocks channel 165 so as to prevent the active chemical from exiting from the dispenser 120 when not in the spray phase. A pair of o-rings 163 are disposed between the inner surface of wall 177 and the outer surface of wall 141 to further ensure that no active chemical or propellant is able to exit dispenser 120 through vent 156 that extends through wall 141. An annular channel 153 surrounds plug 164 and joins channels 165 and 175 in fluid communication during the spray phase.

The propellant valve assembly 151 includes an annular wall 179 defining a conduit 142 that extends axially from valve stem 143 into an accumulation chamber 146. Accumulation chamber is defined by a diaphragm 150 that extends radially from a wall 161 that is disposed at the interface between cover 149 and the axially outer end of wall 179, axially inner portion of wall 161, inner surface of wall 179, and outer surface of wall 141. Diaphragm 150 is further connected at its radially inner end to wall 141.

Wall 179 includes a flange 159, similar to flange 173 of wall 177, that engages valve stem 143, and defines a channel 181 extending there through that joins valve stem 143 and conduit 142 in fluid communication. A porous flow control media 158 is disposed within channel 142 axially downstream from flange 159 so as to regulate the flow of propellant into accumulation chamber 146.

When the dispenser 120 is initially mounted onto can 122, neither conduit 138 or 143 are actuated. However, referring now to FIG. 8, once the dispenser 120 is rotated to the "ON" position, thereby beginning the accumulation phase, flanges 159 and 173 are translated axially upstream and depress valve stems 143 and 138, respectively. Active chemical thus travels through conduit 133, valve 137, and into conduit 165. The active is prevented, however, from flowing into conduit 175 by the seal provided by plug 164 and o-rings 163.

The propellant travels through valve 140, channel 181, porous media 158, conduit 142, and into accumulation chamber 146. Once the pressure of propellant acting on the axially inner surface of diaphragm 150 exceeds a predetermined threshold, the diaphragm becomes deformed from the normal closed position illustrated in FIG. 7 to the open position illustrated in FIG. 10.

This initiates a spray phase, during which the diaphragm 150 causes wall 141 to become displaced axially upstream, thereby removing the inlet to channel 175 from the plug 164. Accordingly, active chemical flows along the direction of arrow N from conduit 138, through channel 153, and into conduit 175 where it exits the dispenser 120 at outlet 167. When wall 141 is displaced, the seal between o-rings 163 and the inner surface of wall 141 is maintained.

As a result, propellant is prohibited from traveling from accumulation chamber 164 through the gap formed between the radially inner surface of wall 177 and the radially outer surface of wall 141. The pressure within accumulation chamber 146 will thus remain above the threshold to enable an essentially total release of the active chemical from can 122. It should be appreciated that dispenser 120 could also include a locking mechanism of the type illustrated in FIG. 6 to mechanically prevent wall 141 from being displaced axially upstream during the spray phase.

Figure 11:
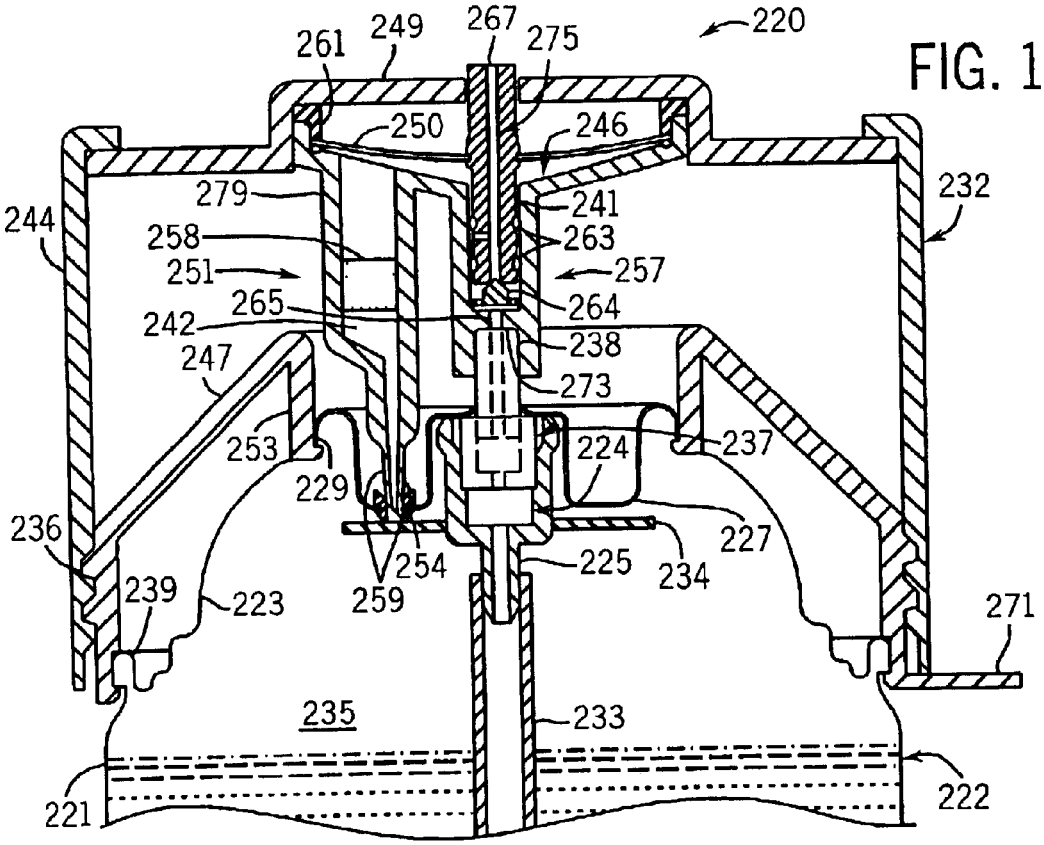
FIG. 11 is a sectional view of an automatic dispensing valve assembly of yet another embodiment, in an "off" configuration.
Figure 12:
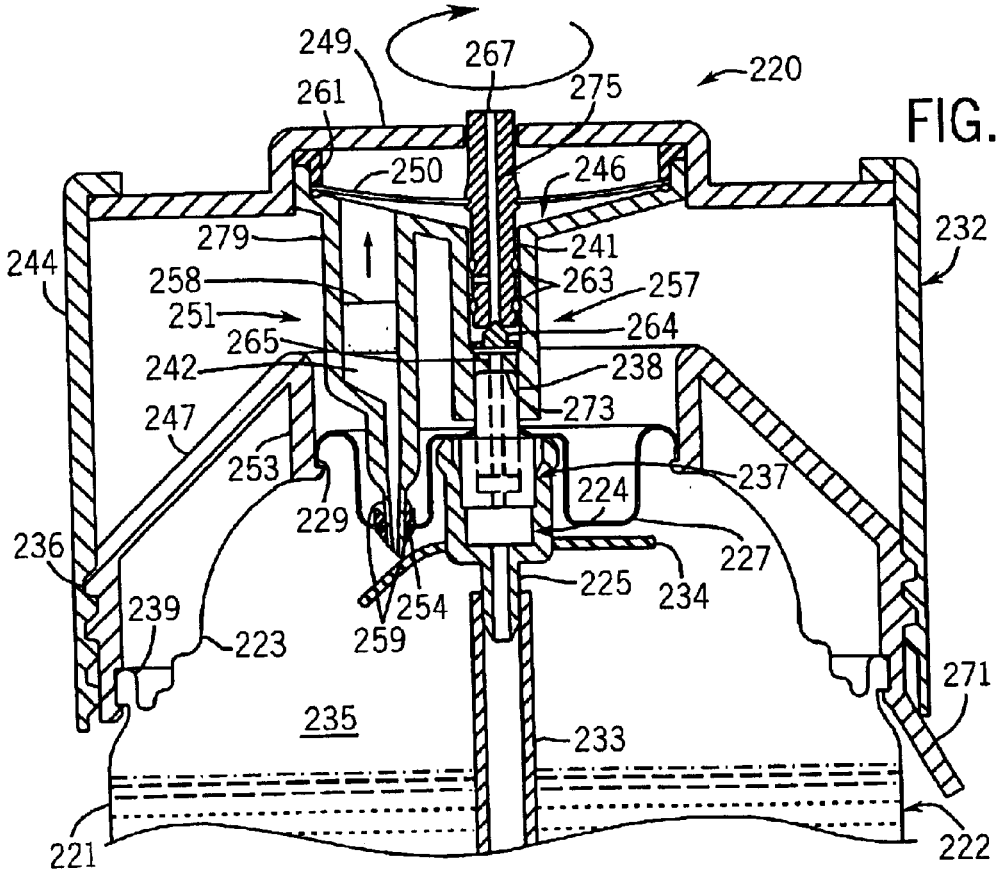
FIG. 12 is a view similar to FIG. 11, but with the valve in an "on" configuration during the accumulation phase of the dispensing cycle.

Referring next to FIGS. 11 and 12, a dispenser 220 is illustrated having a similar construction to that of the last embodiment. The primary differences reside in the active valve assembly 257 and propellant valve assembly 251.

In particular, the active valve assembly 257 includes an annular lip 225 that extends axially upstream into conduit 233, and defines and interior cavity 224. The axially upstream end of lip 225 fits inside conduit 233 to deliver active to valve 237.

The propellant valve assembly 251 includes a flexible seal 234 extending radially outwardly from member 225 such that the axially outer surface of seal 234 rests against the axially inner surface of a seat 254. Seat 254 is disposed within the cup 234, and receives inner and outer fork members 259 therein. Fork 259 defines the axially inner end of a wall 279 that encloses a conduit 242 that flows into accumulation chamber 246. A porous flow control media 258 is disposed within conduit 242.

When the dispenser is in the "OFF" position illustrated in FIG. 11, seal 234 prevents propellant from entering channel 242. However, referring to FIG. 12, when assembly 232 is further rotated to switch the dispenser "ON," fork members 259 are displaced axially upstream against seal 234 which deflects outwardly away from seat 254. Because inner fork member is displaced axially downstream from outer fork member, the inlet to channel 242 is exposed to upper portion 235 of can 222, thereby enabling propellant to enter accumulation chamber 246 via conduit 242.

Figure 13:
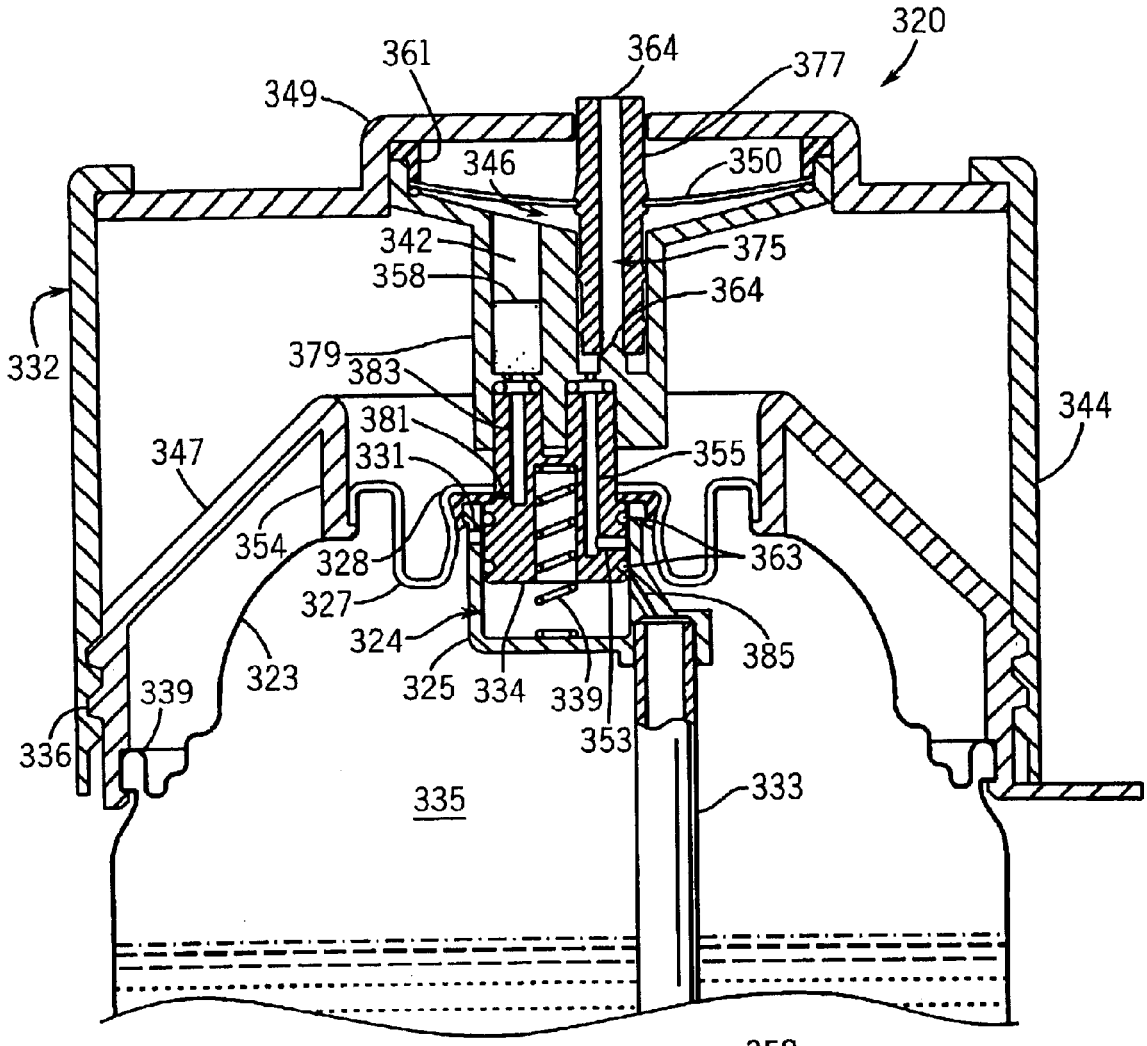
FIG. 13 is a sectional view of an automatic dispensing valve assembly of still another embodiment, in an "off" configuration.
Figure 14:
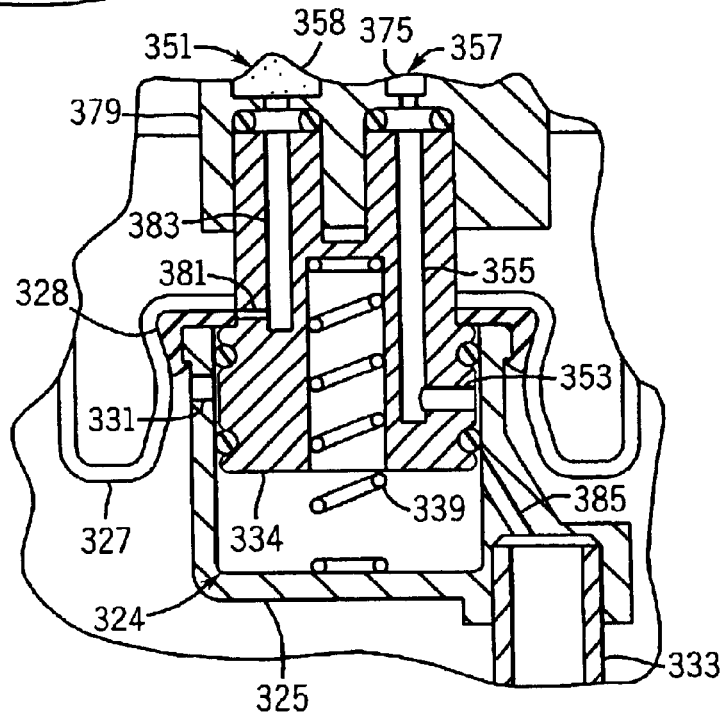
FIG. 14 is an enlarged view of a part of the valve assembly of FIG. 13.
Figure 15:
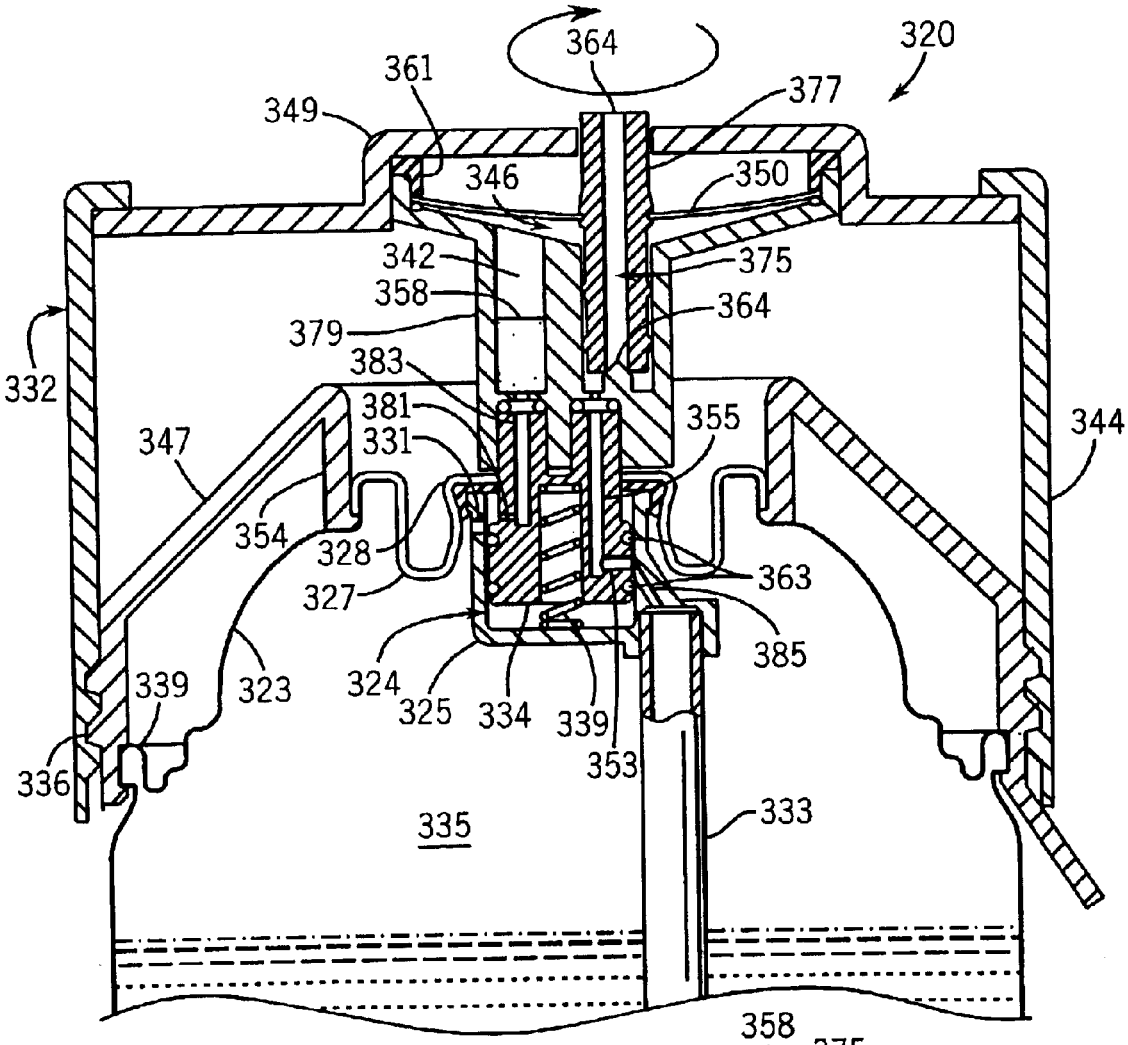
FIG. 15 is a view similar to FIG. 13, but with the valve in an "on" configuration during the accumulation phase of the dispensing cycle.
Figure 16:
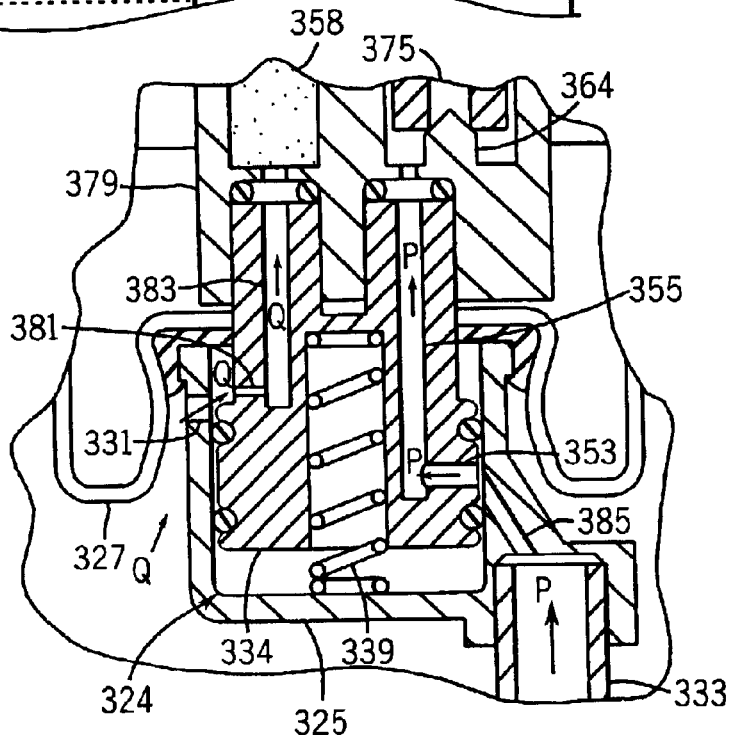
FIG. 16 is an enlarged view of part of a valve dispensing portion of the valve assembly of FIG. 15.
Figure 17:
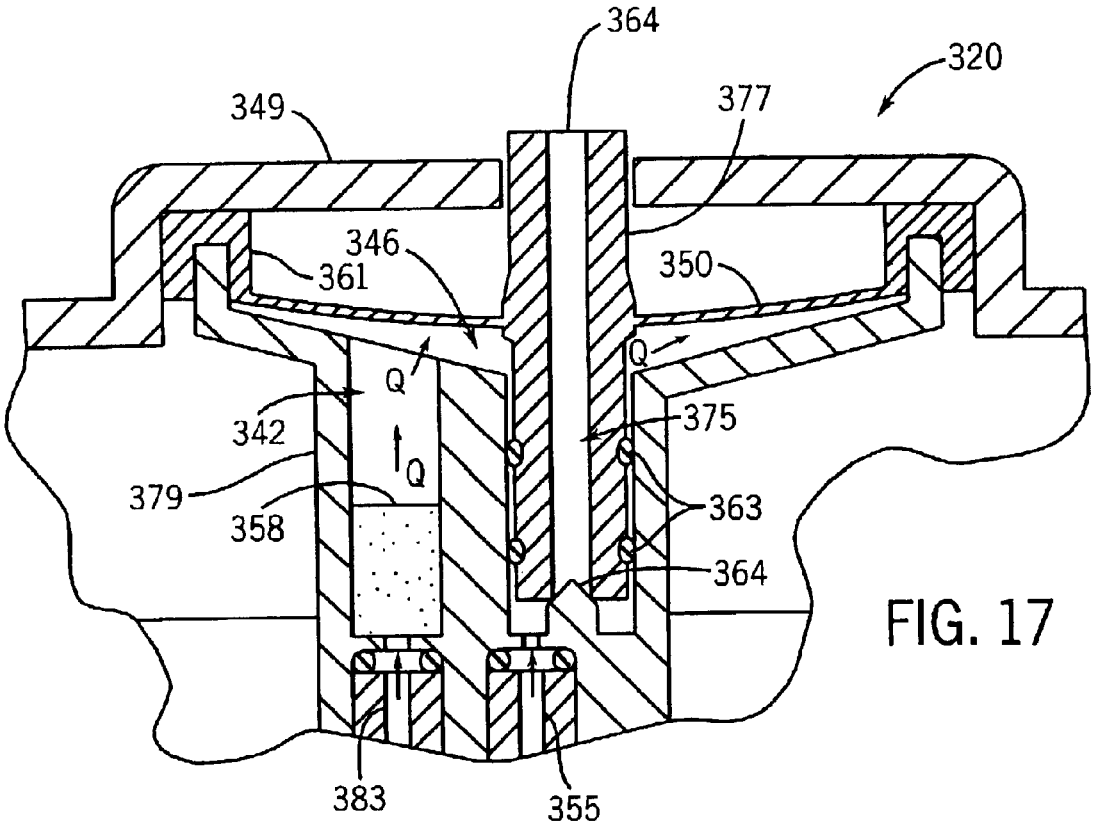
FIG. 17 is an enlarged view of the accumulation chamber portion of the valve assembly of FIG. 15.
Figure 18:
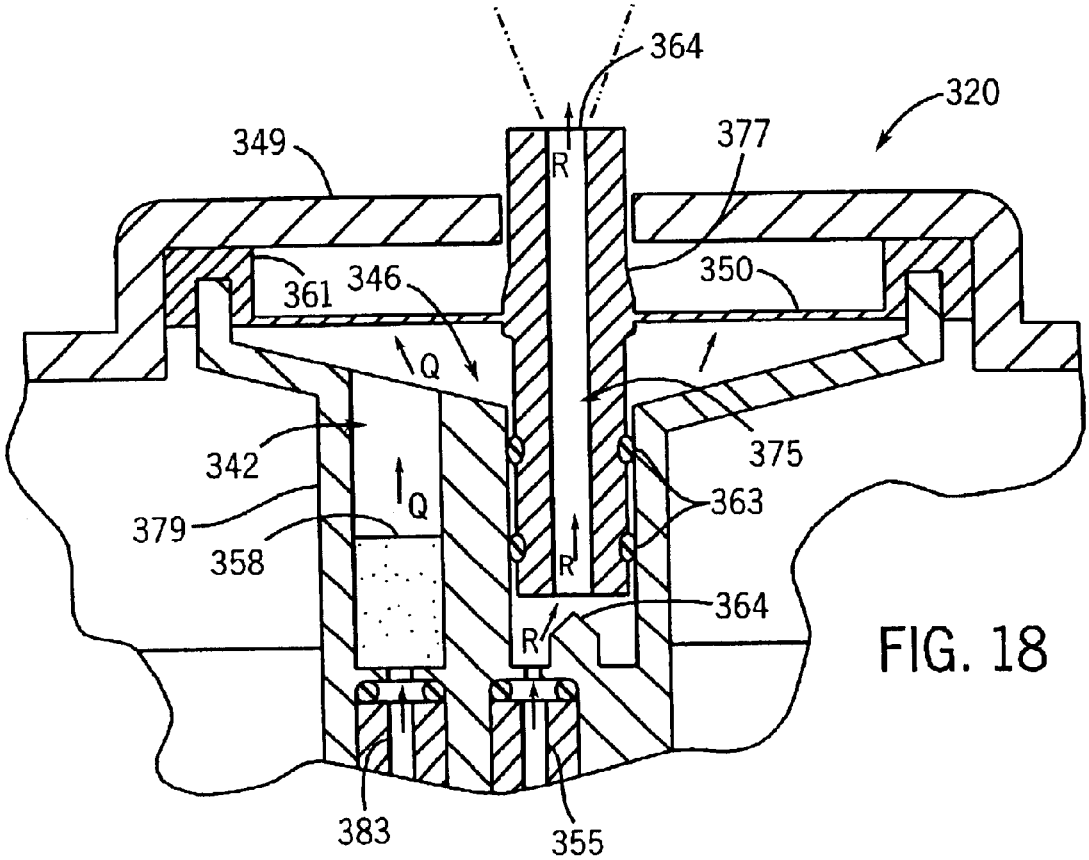
FIG. 18 is a view similar to FIG. 17, but with the valve in the spray phase.

Referring now to FIGS. 13 and 14, a dispenser 320 in accordance with yet another embodiment is mounted onto can 322 in the same manner as described above in accordance with the previous embodiment. However, a spring 339 is seated within annular member that biases tee 334 axially outwardly and against the cup 327.

Tee 334 is disposed within the cavity 324. Annular member 325 defines a channel 385 that extends from conduit 333 into conduit 324. Housing 334 defines a first conduit 353 that extends partially there through in the radial direction, and terminates at an axially extending conduit 355. Conduit 355 is in fluid communication, at its axially outer end, with a conduit 375 that extends axially out the dispenser as an active chemical outlet 364. Conduit 375 is defined by an axially extending annular wall 377. However, when the dispenser is either "OFF" or in the accumulation phase, a plug 364 blocks the entrance into conduit 375. Furthermore, when the dispenser 320 is in the "OFF" position, conduits 385 and 353 are not in radial alignment.

Annular member 325 further defines a propellant intake channel 331 extending radially there through and in fluid communication with upper region 335 of can 322. Tee 334 defines a channel 381 extending partially there through in the radial direction, and terminates at the axially upstream end of an axially extending conduit 383. Conduit 383, at its axially outer end, is in fluid communication with a conduit 342 that opens into accumulation chamber 346. A porous media 358 is disposed in conduit 342 to regulate the flow of propellant into accumulation chamber 346. However, when the dispenser is in the "OFF" position, conduits 331 and 381 are not aligned.

An annular seal 328 is disposed around the periphery of tee 334, and positioned between wall 325 and cup 327. A pair of o-rings 363 are disposed at the radial interface between walls 325 and 334 at a position axially inwardly and outwardly of channels 353 and 331. The seal 328 and o-rings 363, in combination with the offset of the propellant and active channels, described above, prevents the flow of active and propellant into dispenser 320 when the dispenser is in the "OFF" position.

Referring now to FIGS. 15–18, when the dispenser 320 is turned "ON" by rotating the control assembly 332, the accumulation phase begins whereby tee 334 is displaced axially upstream against the force of spring 339. Accordingly, channel 353 thus becomes radially aligned with channel 385, and active chemical flows into dispenser 320 along the direction of arrow P. However, because plug 364 is blocking the entrance into channel 375, active chemical is prevented from exiting the dispenser 320 during the accumulation phase.

As tee 334 is displaced, channel 381 is moved into radial alignment with channel 331, thereby enabling propellant to travel along the direction of arrow Q into and through conduit 383 and porous media 358, and into accumulation chamber 346 via channel 342. Propellant accumulates in chamber 346 until the pressure reaches a predetermined threshold, at which point the diaphragm 350 is deformed from the closed position to the open position illustrated in FIG. 20.

When the diaphragm 350 flexes axially downstream to the open position, walls 377 and 341 are also displaced axially downstream. Accordingly, the inlet to channel 375 is displaced from the plug, and active chemical is able to flow from channel 355 into channel 375 and out the active chemical outlet 364. Because the seal between the o-rings 363 and wall 377 is maintained during the spray phase, propellant is prohibited from escaping from dispenser 320. It should be appreciated that dispenser 320 could again also include a locking mechanism of the type illustrated in FIG. 6.

Figure 19:
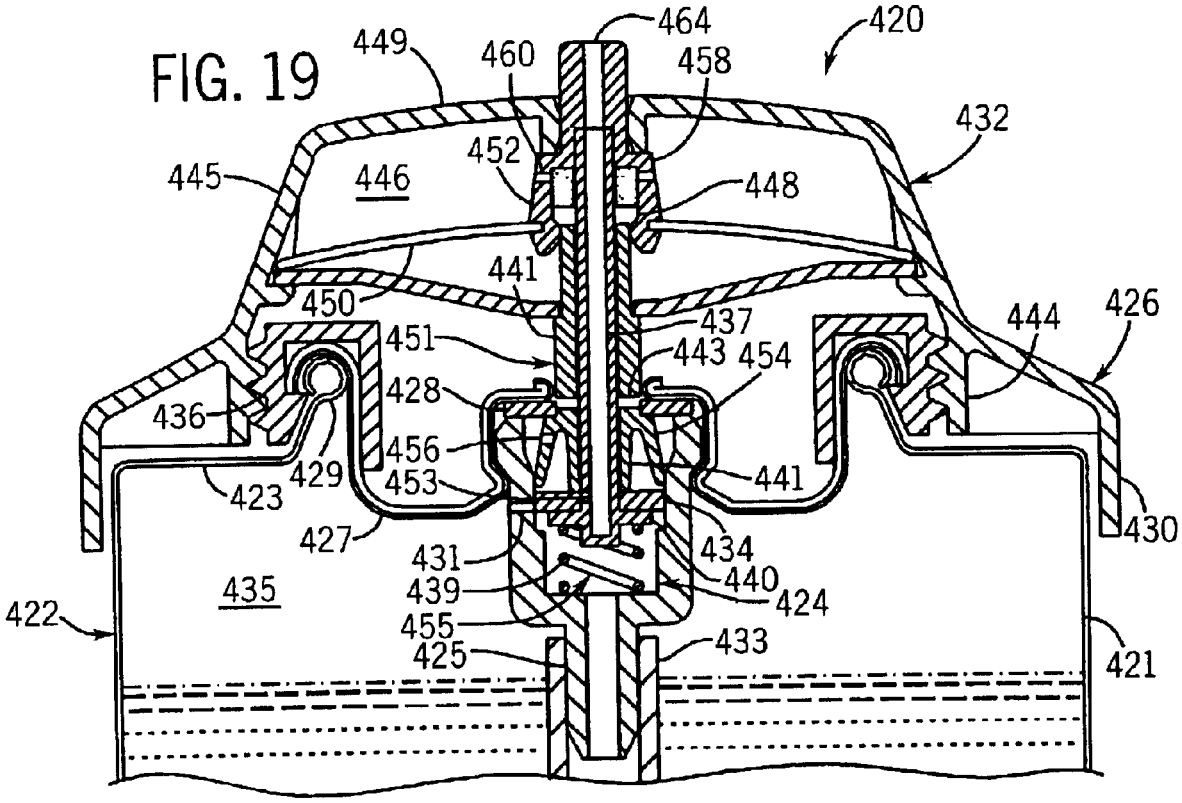
FIG. 19 is a sectional view of another embodiment of an automatic dispensing valve assembly of the present invention, in an "off" configuration, mounted onto an aerosol can.
Figure 20:
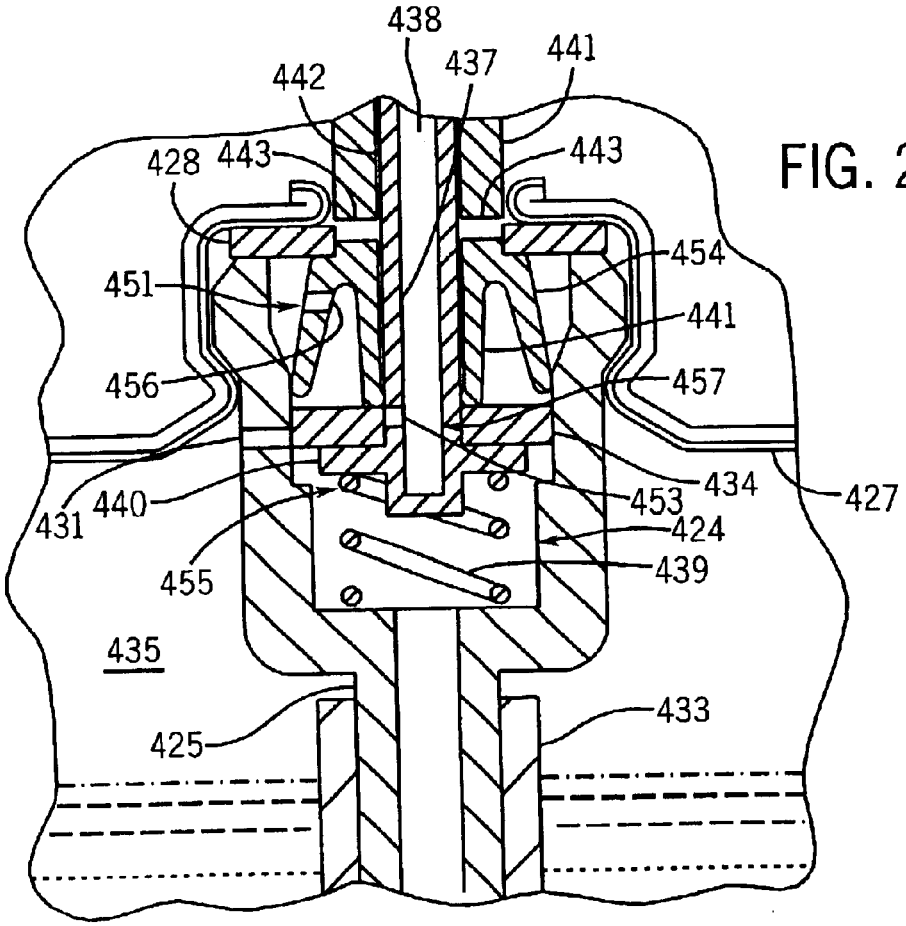
FIG. 20 is an enlarged sectional view of a part of the valve assembly of FIG. 19.

Referring next to FIGS. 19 and 20, an aerosol can 422 includes a cylindrical wall 421 that is closed at its upper margin by a dome 423. The upper margin of the can wall 421 is integrally formed with the dome 423, but could alternatively be joined at a can chime (not shown). An upwardly open cup 427 is located at the center of the dome 423 and is joined to the dome by a rim 429.

The can 422 includes an axially extending conduit 433 that is centrally disposed therein, and opens into a mixed pressurized chemical (active and gas propellant) at one end (preferably towards the bottom of the can). The upper region 435 of the can interior above the active chemical line contains pressurized gas propellant. The upper end of conduit 433 receives a tee 425 that interfaces with the interior of dispenser 420, through which the chemical may be expelled.

Dispenser 420 includes a valve assembly 455 having a gas propellant valve assembly 451 and an active valve assembly 457. Dispenser 420 is mostly polypropylene, albeit other suitable materials can be used.

The dispenser 420 has a lower portion 426 including an inner wall 444 and peripheral skirt 430 that are joined at their axially outer ends and form part of a control assembly 432.

The inner wall 444 and skirt 430 engage the valve cup rim 429 and outer can wall 421, respectively. In particular, rim 429 is snap-fitted within a cavity formed by a wall 436 that has threads face radially outwardly. The inner wall 444 has radially inwardly extending threads that intermesh with threaded wall 436. The skirt fits over the outer can wall 421. In operation, the dispenser 420 may be switched "ON" and "OFF" by rotating member 432 relative to the can 422.

As best seen in FIG. 20, the tee 425 defines an interior cavity 424 disposed axially downstream from conduit 433. Tee 425 is sized so as to be crimped within the open end of cup 427. An elongated annular wall 437 defines a first conduit 438 that extends axially from the interior of cavity 424 and centrally through the dispenser 420 to deliver the active mixture from the can 422 to the dispensing nozzle 464.

Tee 425 defines a passageway 431 extending between cavity 424 and gaseous collection portion 435. A seal 434 is disposed radially inwardly and aligned with passageway 431 when the dispenser 420 is in the FIG. 20 "OFF" position. Accordingly, gas from can 422 is unable to flow into tee 425 in this orientation.

The axially outer end of tee 425 is sealed by an annular sealing member 428, which is disposed between the axially outer edge of tee 425 and axially inner edge of cup. Sealing member 428 restricts the path of the gas propellant traveling from the can 422 into the dispenser.

A second elongated annular wall 441 extends concentrically with wall 437, and has an inner diameter slightly greater than the outer diameter of wall 437. An axially extending gap 442, which provides a gas propellant intake channel, is thus formed between walls 441 and 437. Wall 441 comprises an outer portion and inner portion that are co-axial and separated to form a channel 443 extending into intake channel 442. When the dispenser is "OFF," channel 443 is radially aligned with seal 428.

A lower portion of wall 441 defines a channel 453 extending radially there through and initially aligned with seal 434. This portion further includes a radially outer leg 454 that extends axially upstream from the wall 441. Leg 454 defines a channel 456 extending radially there through that allows gas propellant to flow into the dispenser 420 when the dispenser is "ON," as will become apparent from the description below.

Upper portion of wall 441 and intake channel 442 terminate at their axially outermost ends at an inlet 448 to an accumulation chamber 446 that accepts gas propellant from can 422. A porous media 458, which is preferably made of a low porosity ceramic or any other similarly permeable material, is disposed in inlet 448 to regulate the flow rate of gas propellant entering the accumulation chamber 446. A channel 460 extends radially through the retainer wall radially between accumulation chamber 446 and porous media 458, and defines the mouth of the accumulation chamber.

Figure 24:
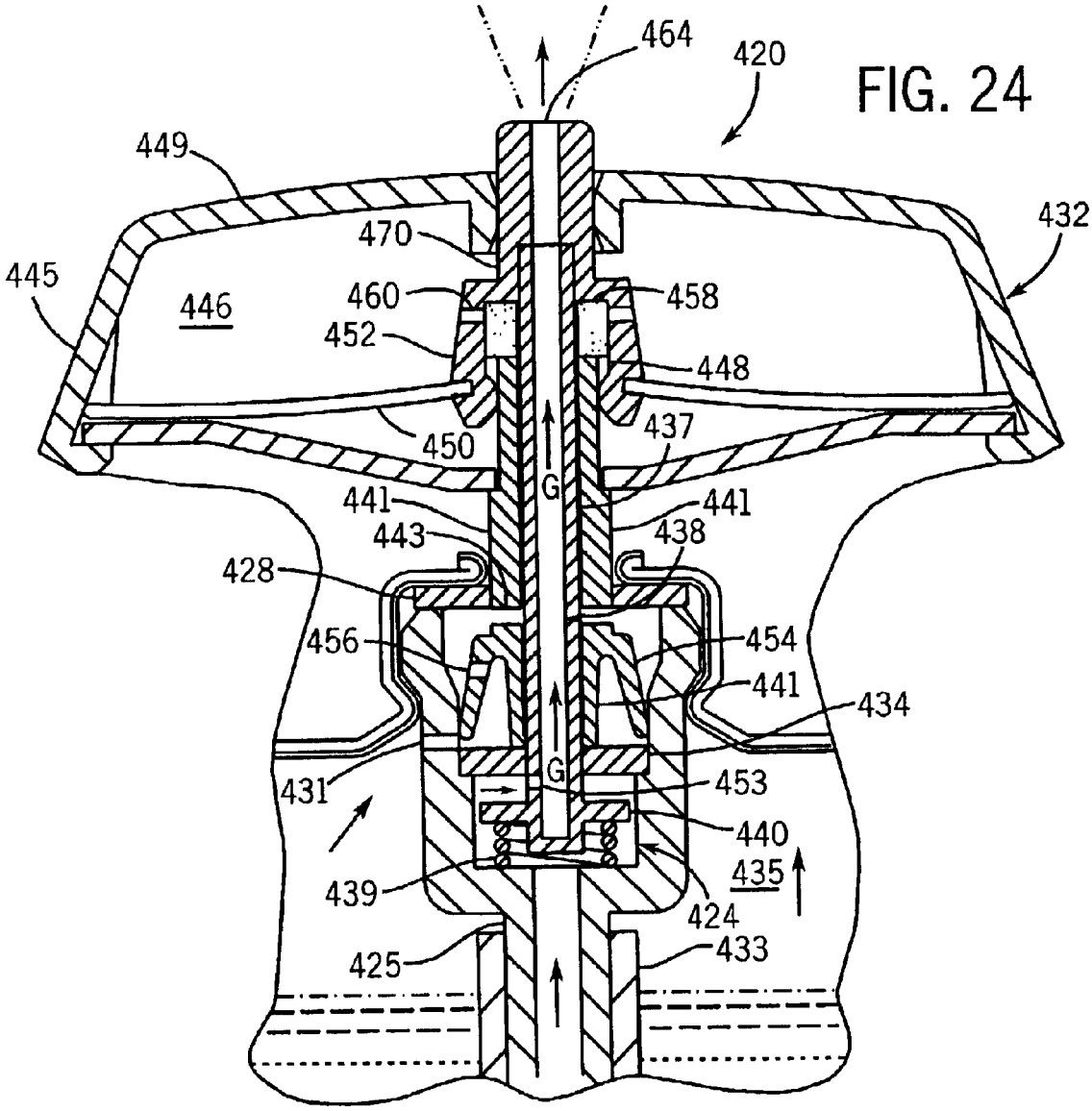
FIG. 24 is a view similar to a portion of FIG. 19, but with the valve assembly in a spray configuration.
Figure 25:
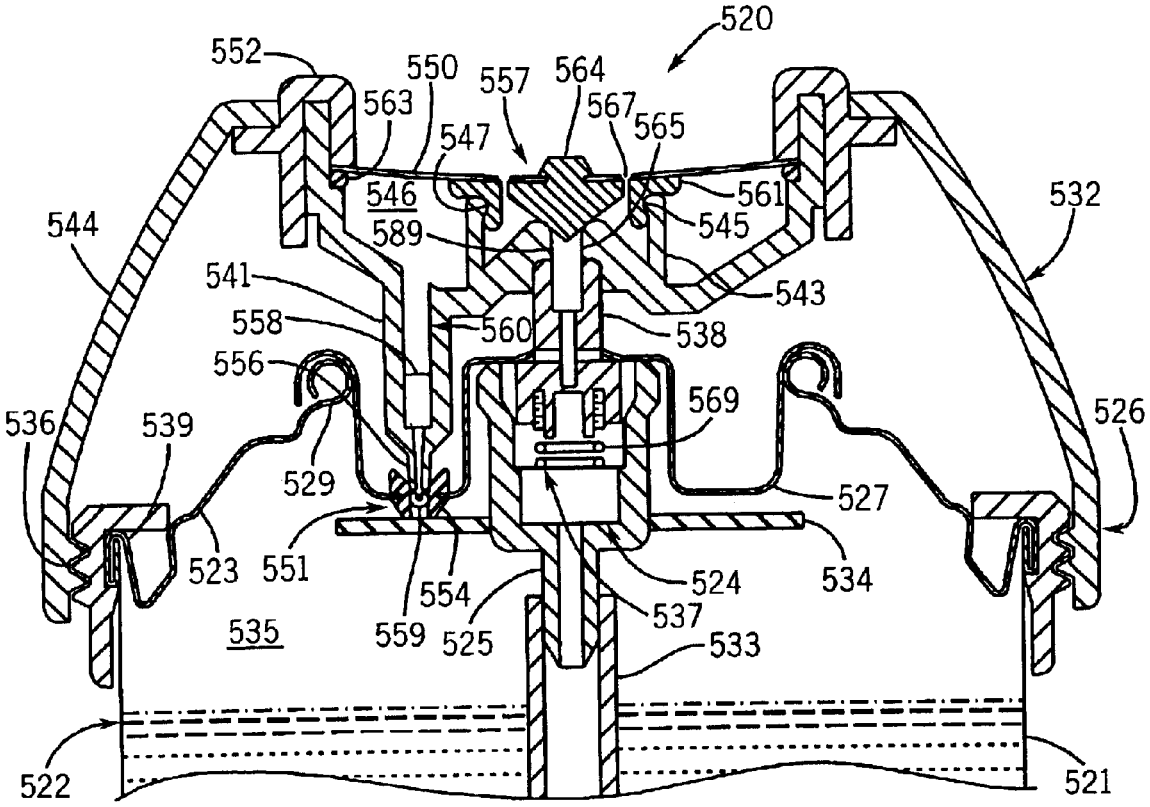
FIG. 25 is a sectional view of an automatic dispensing valve assembly of yet another embodiment in an "off" configuration.

The accumulation chamber 446 is defined at its axially outer end by a cover 449 that extends radially at the axially outermost edge of outer wall 445, which extends axially downstream from wall 444. Wall 445 further defines the radially outer edge of accumulation chamber 446. The axially inner portion of accumulation chamber 446 is defined by a flexible, mono-stable diaphragm 450 that is movable from a first closed position (FIG. 19), to a second open position (FIG. 24) to totally release the active chemical. The radially outer edge of diaphragm 450 extends into a groove formed within the radially inner surface of wall 445. The radially inner edge of diaphragm 450 is seated in a groove formed within a retainer wall 452 that is connected to wall 441.

The lower end of retainer wall 452 is sealed against the radially outer edge of wall 441 at its upper end. The radially outer surface of retainer wall 452 abuts a surface of cover 449 and is slideable there along. The upper end of retainer 452 defines dispensing nozzle 464.

A spring member 439 is disposed within cavity 424 and rests against a flange 440 that extends radially outwardly from the lower end of wall 441 to bias walls 437 and 441 (and seal 434) axially upward. When the dispenser is "OFF," the spring force is forcing the upper edge of wall 456 tightly against sealing member 428. Because channel 431 and cavity 424 are also sealed in this configuration, neither gas propellant nor active mixture is permitted to flow from the can 422 into the dispenser. The dispenser 420 is thus in a storage/shipment position.

Figure 21:
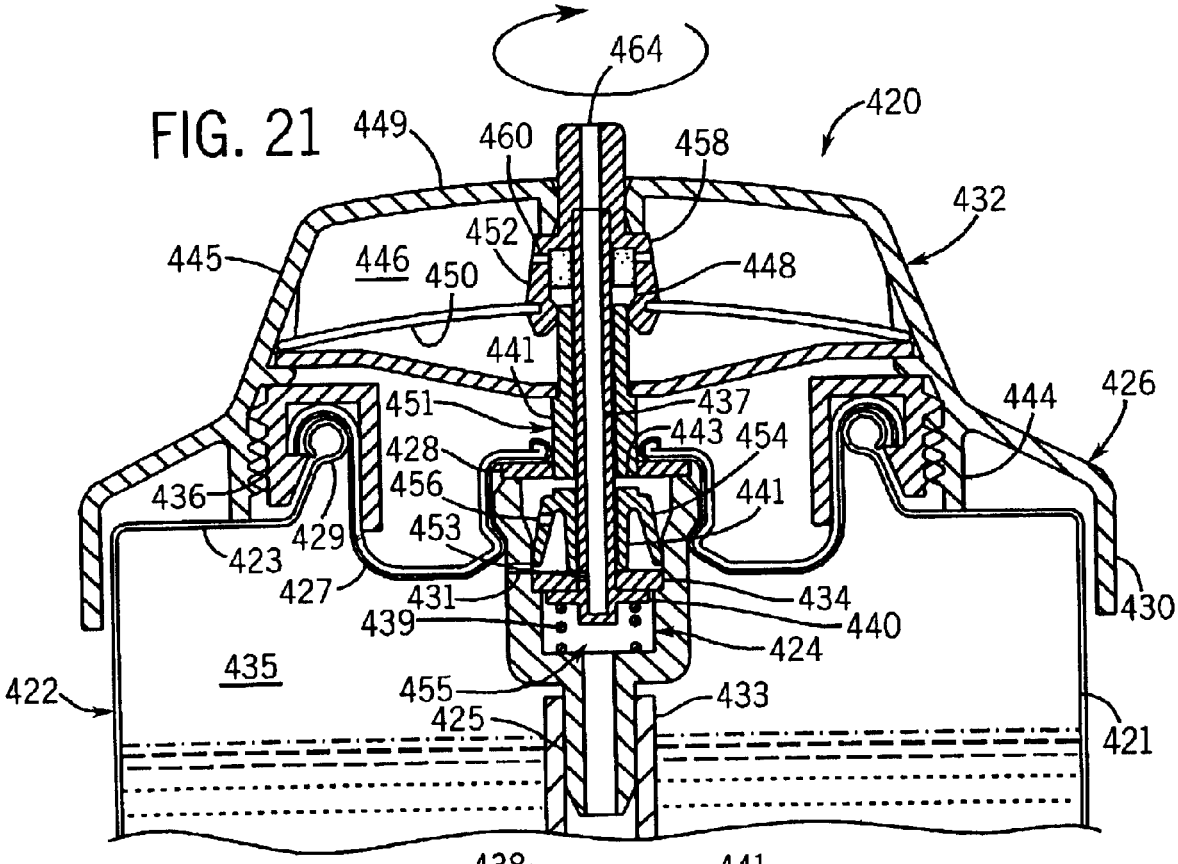
FIG. 21 is a view similar to FIG. 19, but with the valve in an "on" configuration.
Figure 22:
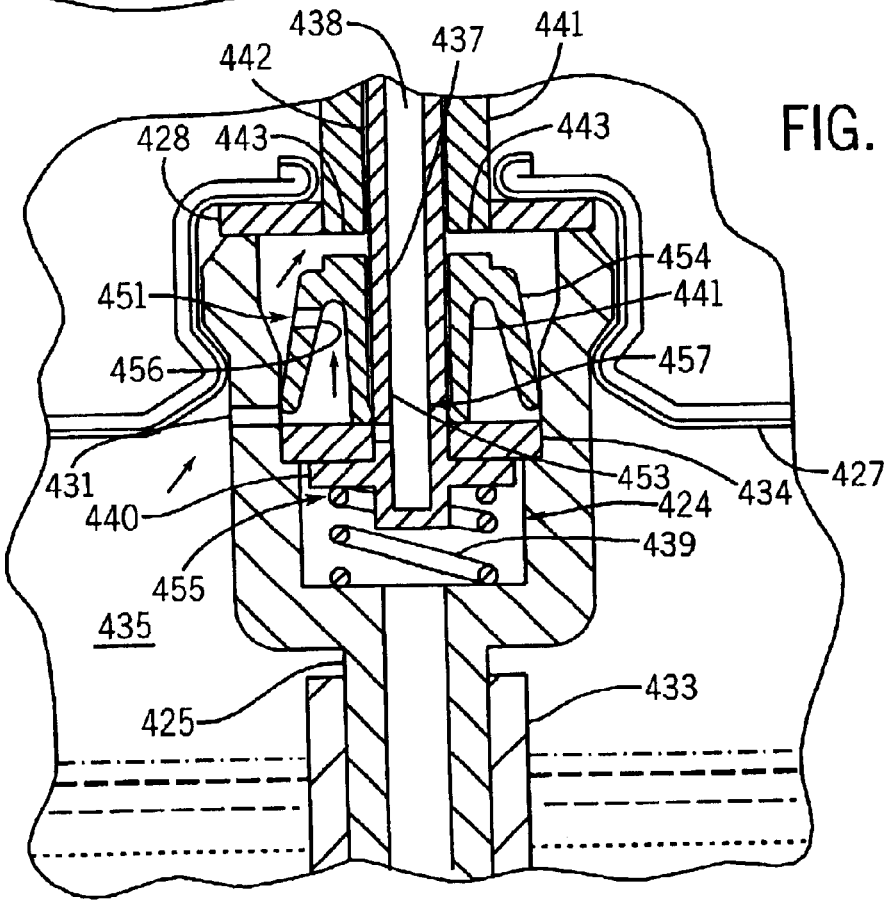
FIG. 22 is a view similar to FIG. 20 of the valve assembly of FIG. 21, with the valve in an accumulation phase.
Figure 23:
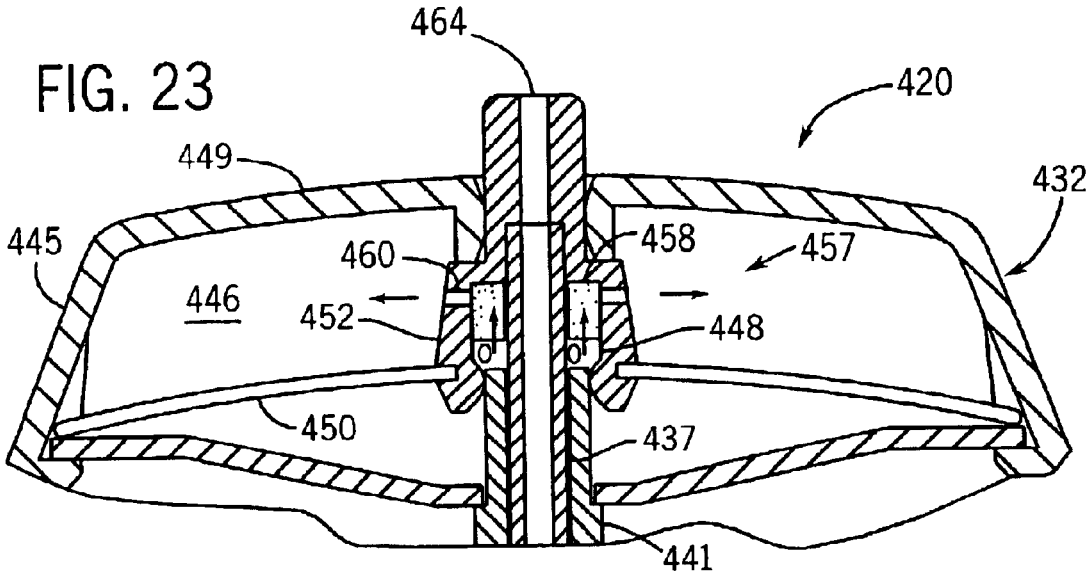
FIG. 23 is an enlarged view of the accumulation chamber of the valve assembly of FIG. 21.

Referring specifically to FIGS. 21–23, as the control assembly 432 is rotated to displace the dispenser 420 axially inwardly, wall 441 is displaced downward against the force of spring 439. The seal 434 is thus removed from alignment with channel 431, and channel 443 is axially below seal 428. An accumulation phase is thereby initiated, in which the pressurized gas propellant flows from the can 422.

Referring to FIG. 21 in particular, after the gas propellant enters cavity 424 through channel 431, it further travels upstream through channels 456 and 443 into intake channel 442. The gas propellant then travels axially downstream through channel 442 and into inlet 448 where it is regulated by porous flow control media 452 before flowing into the mouth 460 of accumulation chamber 446. Because, at this point, seal 434 remains aligned with channel 453 during the accumulation phase of the gas, the active mixture in the can 422 is unable to flow into the dispenser 420.

Figure 27:
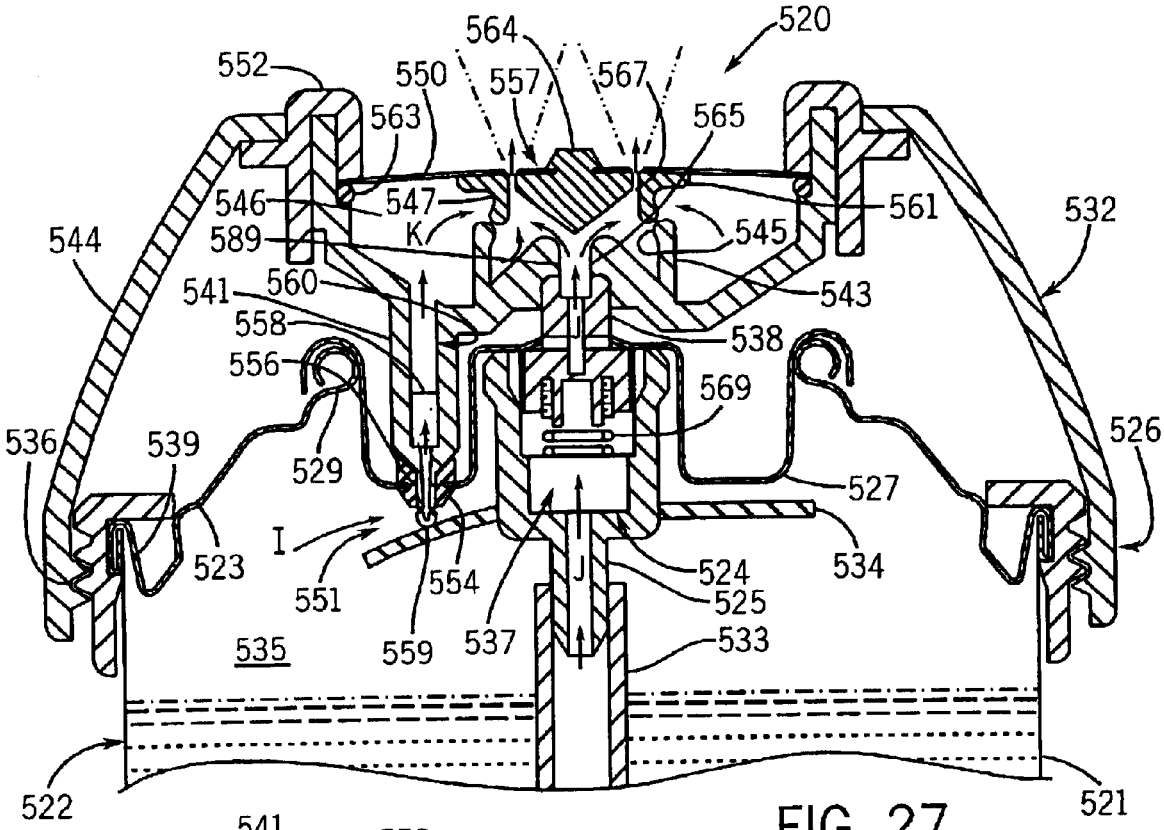
FIG. 27 is a view similar to FIG. 26, but with the valve assembly in the spray phase.

During the accumulation phase, the constant supply of gas propellant flowing from intake channel 442 into the accumulation chamber 446 via mouth 460 causes pressure to build therein, and such pressure acts against the upper outer surface of diaphragm 450. Once the accumulation chamber 446 is sufficiently charged with gas propellant, such that the pressure reaches a predetermined threshold, the mono-stable diaphragm 450 becomes deformed from the normal closed position illustrated in FIG. 27 to the open position illustrated in FIG. 24.

This initiates a spray phase, during which the diaphragm 450 causes retainer wall 452 and wall 437 to become displaced downward. Porous flow control media 458 also becomes displaced along with retainer wall 452. Accordingly, the amount of axial displacement is limited by the amount of axial space between flow control media 458 and the edge of wall 441. As wall 437 becomes displaced downward, channel 453 becomes axially displaced upstream from seal 434 and into cavity 424.

Accordingly, active mixture can then flow from the can 422 up into cavity 424, through channel 453 along the direction of arrow G, axially up along conduit 438, and out the nozzle 464 as a spray. The gas propellant remains stored in the accumulation chamber 446 during the spray phase to enable all active chemical to be expelled from can 422.

It should be appreciated that the dispenser 420 and can 422 may be sold to an end user as a pre-assembled unit. In operation, the user rotates the assembly 432 to displace the valve assembly 455 axially inwardly, thereby causing the aerosol contents to flow out of can 422, and beginning the accumulation cycle. The gas propellant flows through conduit 442 and into the accumulation chamber 446. Once the spray phase is initiated, the active mixture flows through conduit 438, and exits the nozzle 464 as a "spray" into the ambient environment.

The duration of the accumulation phase may be controlled, for example, by adjusting the stiffness of diaphragm 450, the internal volume of chamber 446, and/or the porosity of porous flow media 458.

Referring next to FIGS. 25–28, a dispenser 520 is mounted onto a can 522 in accordance with an alternate embodiment. A more conventional container exit valve 537 extends upwardly from the center of the valve cup 527. The valve 537 has an upwardly extending valve stem 538, biased outwardly by a spring 569, through which the active mixture of the can 522 may be expelled. Valve 537 is shown as a vertically actuated valve, which can be opened by moving the valve stem 538 directly downwardly. Instead, one could use a side-tilt valve where the valve is actuated by tipping the valve stem laterally and somewhat downwardly.

Figure 26:
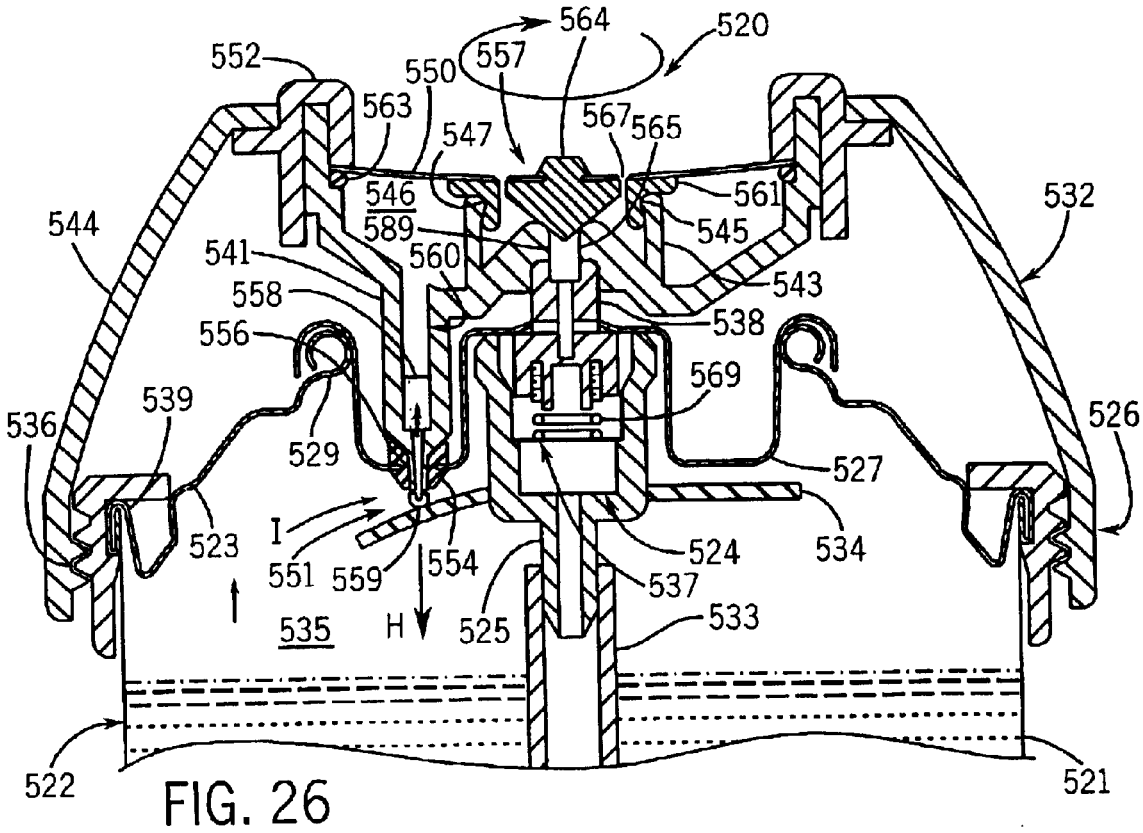
FIG. 26 is a view similar to FIG. 25, but with the valve in an "on" configuration during the accumulation phase.

Control assembly 532 includes an outer wall 544 threaded on its inner surface that intermesh with threads of wall 536 that is connected to the can chime 539. Accordingly, the user may rotate wall 544 to switch the dispenser between the "OFF" position (FIG. 25) and the "ON" position (FIG. 26)

Wall 544 is supported at its axially outer end by wall 552 that receives, in a groove disposed at its lower end, the upper end of a retainer wall 541. An o-ring 563 is disposed at the interface between walls 552 and 541. A monostable, flexible diaphragm 550 extends radially from the interface between the o-ring 563 and wall 552. O-ring 563 thus provides a seal to prevent gas from escaping from the accumulation chamber 546 during the accumulation phase. Wall 541 further includes a flexible protruding member 543 extending axially downstream towards diaphragm 550. Member 543 includes a flange 545 extending radially inwardly from the distal end of member 543. An inverted "L" shaped wall 561 is attached to the inner surface of diaphragm 550, and includes a radially outwardly facing groove 547 that receives flange to prevent the escape of gas propellant during the accumulation phase.

Figure 28:
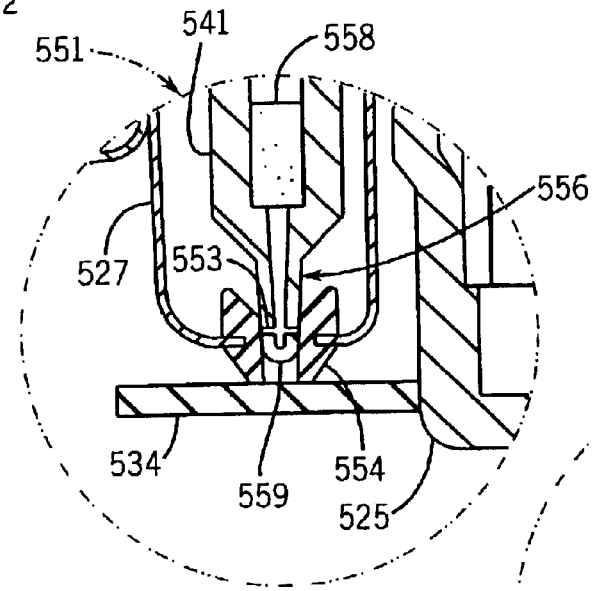
FIG. 28 is an enlarged view of a gas propellant control valve of the valve assembly illustrated in FIG. 25.
Figure 29:
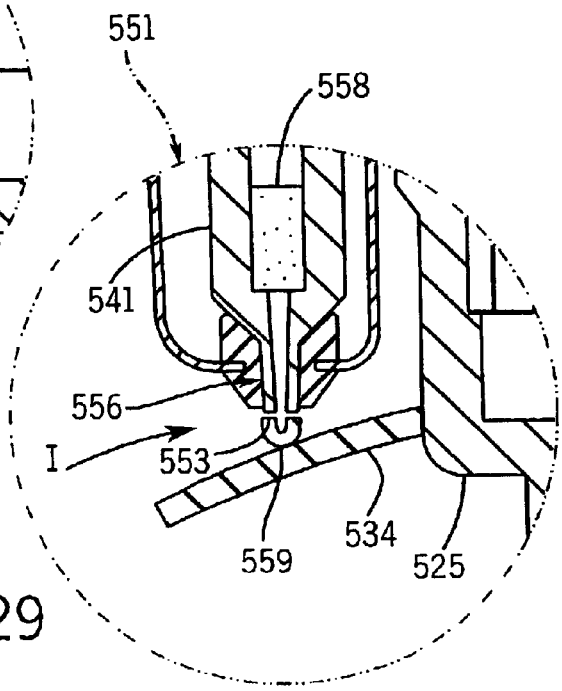
FIG. 29 is another enlarged view of the gas propellant valve of the valve assembly illustrated in FIG. 26, with the valve in a different configuration.

Referring in particular to FIG. 28, dispenser 520 includes a gas propellant valve assembly 551 and an active valve assembly 557. The gas propellant valve assembly 551 includes wall 541, which defines a void that is occupied by a porous media 558. A plunger 556 having a tip 559 is disposed within a seat 554 axially upstream of the porous media 558. Seat 554 is affixed to the cup 527. Plunger 556 is annular, and defines a channel 553 extending there through at a location axially downstream from tip 559. Channel 535 defines the mouth of accumulation chamber 546.

A flexible seal 534 extends radially outwardly from tee 525 such that it rests against the axially inner surface of seat 554. Two seals thus prevent the gas propellant from entering accumulation chamber 546 when the dispenser is "OFF." Seal 534 minimizes leakage during filling of the can and provides a redundant seal to the plunger. A channel 553 is in radial alignment with seat 554, thus forming a seal to prevent gas propellant from entering into the plunger.

An active valve assembly 557 (see FIG. 25) includes a hub 515 that is formed from the radially inner surface of annular retainer wall 541. The hub defines a channel 569 through which the active mixture flows from the valve stem 538 during a spray phase. A plug 564 is attached to the axially inner surface of diaphragm 550, and extends axially inwardly to seal channel 569, thus preventing active chemical from exiting the dispenser 520 during the accumulation phase. An annular opening 567 is disposed in the diaphragm 550 at a position adjacent the plug 567 to enable active chemical to flow from the hub and out the dispenser 520 during the spray phase, as will be described below.

When the control assembly 532 is rotated to switch the dispenser 520 to the "ON" position, the accumulation phase begins. In particular, wall 541 and plunger 556 are biased downwardly such that tip 559 deflects seal 534 away from the seat 554 in the direction of arrow H. The plunger 556 is depressed such that channel 553 is translated to a position axially upstream of seat 554, thereby permitting pressurized gas propellant to enter the channel 553 along the direction of arrow I.

Plug 564 is biased against hub 565, which depresses valve stem 538, thereby pressurizing active chemical against the plug. The seal formed between the plug 564 and hub 565 prevents any active chemical from exiting the dispenser during the accumulation phase.

The gas propellant travels through the porous media and into inlet 560 of the accumulation chamber 546. The constant supply of gas propellant flowing into the accumulation chamber 546 causes pressure to build therein, and such pressure acts against the inner surface of diaphragm 550. Once the accumulation chamber 546 is sufficiently charged with gas propellant, such that the pressure reaches a predetermined threshold, the mono-stable diaphragm 550 becomes deformed from the normal closed position illustrated in FIG. 26 to the open position illustrated in FIG. 27.

This initiates the spray phase, during which the diaphragm 550 is biased axially downstream, thereby also biasing plug 564 and "K" shaped wall 561 axially downstream. As wall 561 translates, flexible member 543 flexes radially outwardly, thus removing flange 545 from groove 547. As wall 561 continues to translate, flange 545 cams over the distal end of wall 561 before becoming disengaged from wall 561, at which point it snaps radially inwardly to its relaxed position. Flange 545, now axially aligned with wall 561, prevents plug 564 and cover 550 from closing even if pressure within the accumulation chamber 546 abates to a level less than the threshold.

During the spray phase, an outlet channel 589 is formed between plug 564 and hub 565 that permits the pressurized active material to flow along the direction of arrow J out the dispenser 520 into the ambient environment. Furthermore, because wall 561 is translated slightly axially downstream of member 543, gas propellant stored in the accumulation chamber 546 during the previous accumulation phase will leak along the direction of arrow K, mix with the active chemical, and exit the dispenser 520. The locking mechanism, provided by the interaction between wall 561 and member 543, ensures that, once the spray phase is initiated, dispenser 520 will enable the total release of aerosol content from can 522.

Figure 30:
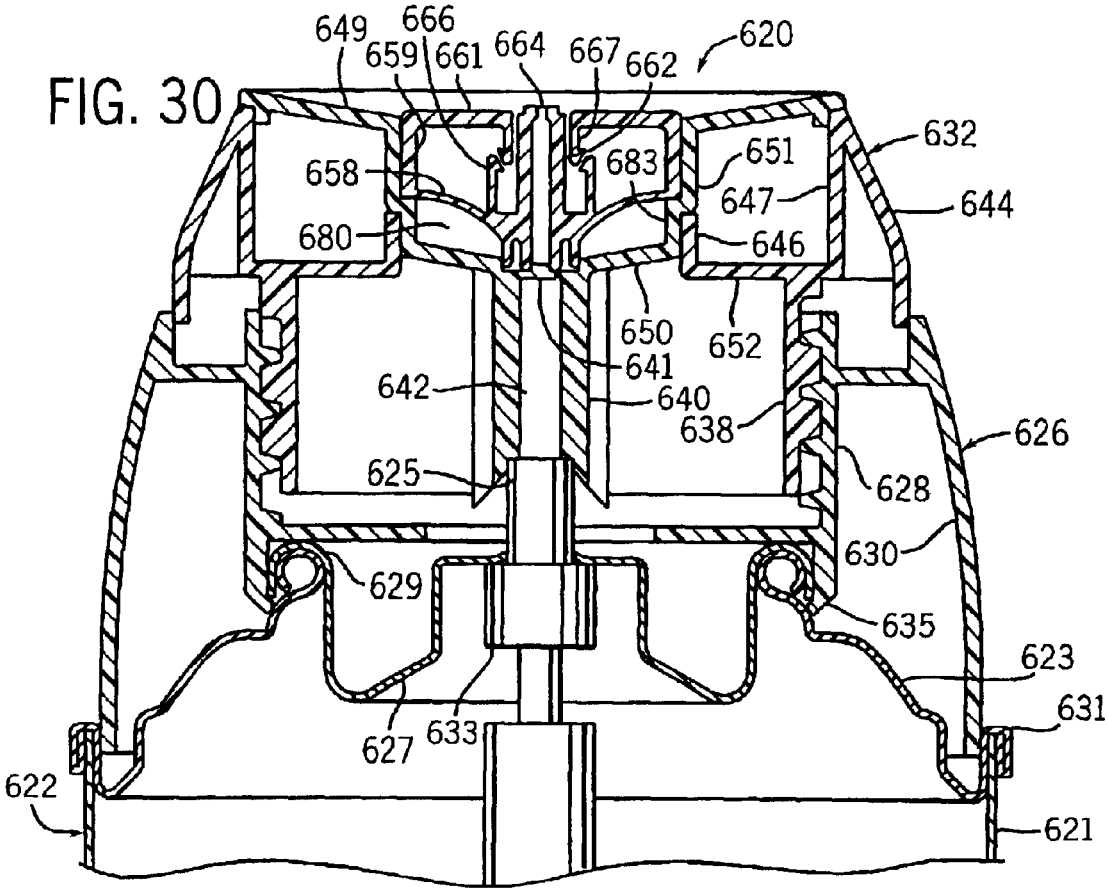
FIG. 30 is a sectional view of another embodiment of an automatic dispensing valve assembly of the present invention in an "off" configuration, mounted onto an aerosol can.

Referring to FIG. 30, an alternate embodiment includes an aerosol can 622 having a cylindrical wall 621 that is closed at its upper margin by the usual dome 623. The upper margin of the can wall 621 is joined to the dome 623 via can chime 631. An upwardly open cup 627 is located at the center of the dome 623 and is joined to the dome by a rim 629.

A conventional valve 633 is located at the center of the valve cup 627. The valve 633 has an upwardly extending valve stem 625, through which the contents of the can may be expelled. Valve 633 is shown as a vertically actuable valve, which can be opened by moving the valve stem 625 directly downwardly. Instead, one could use a side-tilt valve where the valve is actuated by tipping the valve stem laterally and somewhat downwardly.

A valve assembly 620, configured for engagement with the vertically actuated type valve 633, is mostly polypropylene, albeit other suitable materials can be used. The valve assembly 620 has a lower portion 626 including an inner wall 628 and peripheral skirt 630 that are joined at their axially outer ends. The inner wall 628 and skirt 630 engage the valve cup rim 629 and can chime 631, respectively. In particular, inner wall 628 has a radially inwardly extending flange 635 that is configured to snap-fit over the rim 629, while skirt 630 engages the inner surface of chime 631. In operation, the dispenser 620 can be forced downwardly onto the chime 618 and rim 629, thus fastening the dispenser 620 to the aerosol can 622.

Figure 31:
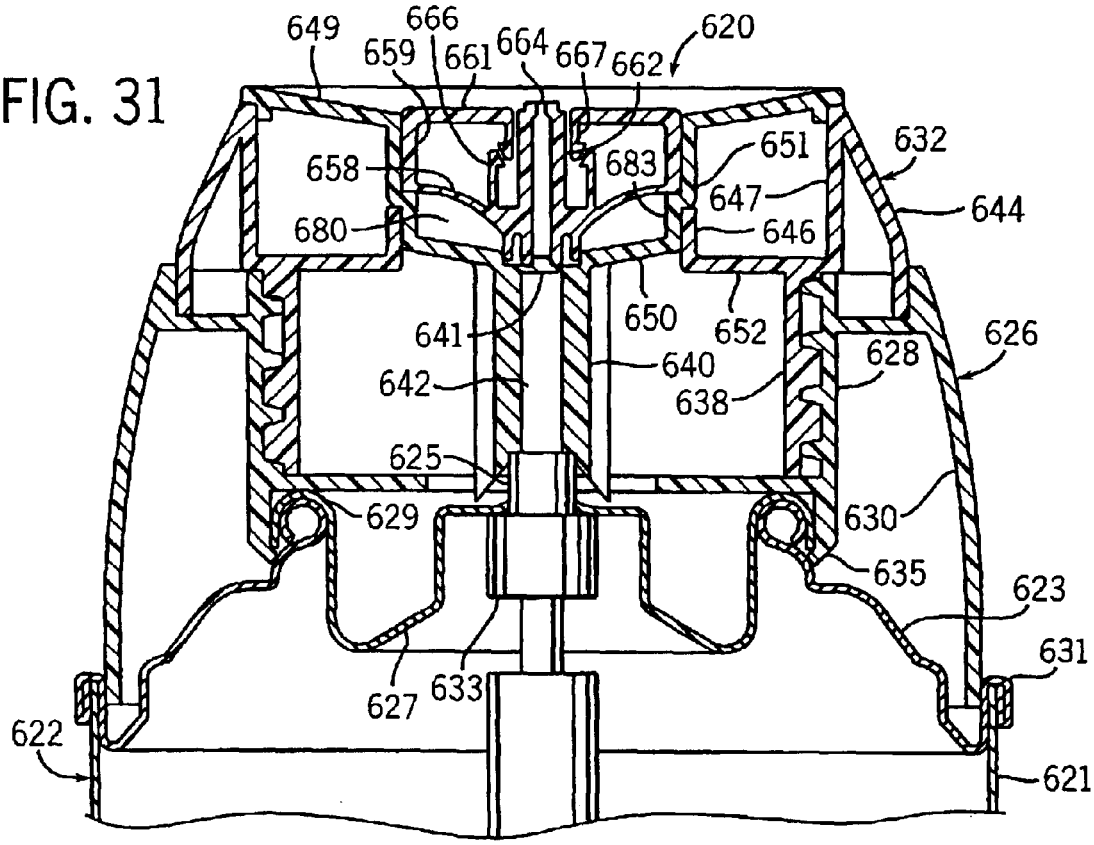
FIG. 31 is a view similar to FIG. 30, but with the valve in an "on" configuration.
Figure 32:
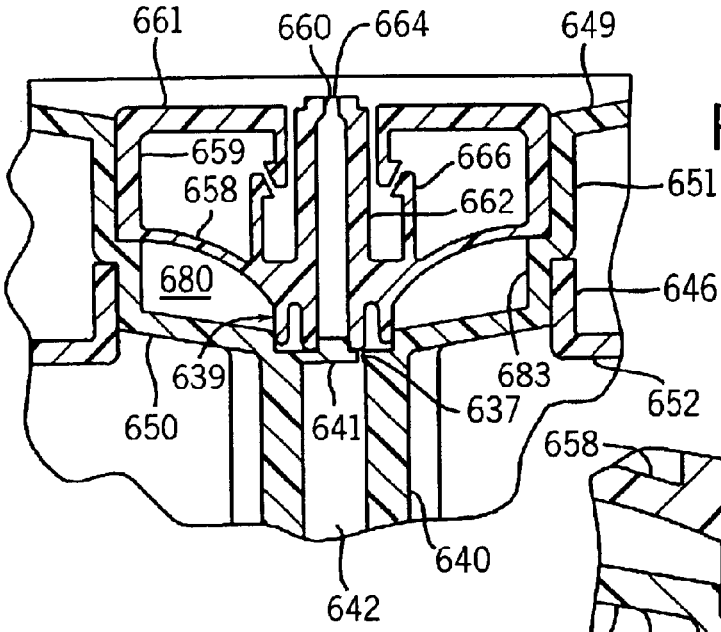
FIG. 32 is an enlarged detail sectional view focusing on a portion of the FIG. 31 view.

Inner wall 628 is threaded on its radially inner surface to receive an assembly 632 that is rotatable therein. Assembly 632 includes an annular wall 638 that is threaded on its outer surface to engage the threads of inner wall 628. The threads have a predetermined pitch such that, as the assembly 632 is rotated clockwise with respect to the assembly 626, it is displaced axially along the direction of Arrow A with respect to aerosol can 622 to activate the valve 633 (FIG. 31) and begin the dispensing cycle. The dispenser 620 may subsequently be disengaged from the can 622 by rotating assembly 632 counterclockwise, and thus saved for future use.

The dispensing cycle includes an accumulation phase and a spray phase, as described above. During the accumulation phase, aerosol content flows from can 622 and into the dispenser to generate pressure therein. Once the pressure within the dispenser reaches a predetermined threshold, the spray phase is initiated, whereby the aerosol content disposed within the dispenser is totally released via an outlet 664 (unless the dispenser is disconnected during the spray phase). During the spray phase, additional aerosol content is permitted to flow from can 622 and out the outlet 664.

Assembly 632 further includes an annular wall 640 disposed radially inwardly of wall 638 that defines therein an axially extending cylindrical first pathway portion 642 that is axially aligned with valve 633. When assembly 626 is initially mounted onto aerosol can 622, the axially inner edge of wall 640 is located adjacent and radially aligned with the valve stem 625. However, it is not pressing down on stem 633.

Because the valve stem 633 is not yet activated in this position, the valve assembly 632 has not yet engaged the aerosol can 622, and the assembly is in a storage/shipment position. However, as the valve assembly 632 is rotated to displace the dispenser 620, wall 640 depresses the valve stem 625, thereby engaging the valve assembly with the aerosol can 622 and allowing the aerosol content to flow from the can into the upper valve assembly.

Assembly 632 further includes an annular wall 647 that extends axially downstream from wall 638, and is displaced slightly radially outwardly with respect thereto. An outer annular sealing wall 644 extends axially upstream and radially outwardly from the axially outermost edge of wall 647. The outer surface of axially inner portion of wall 644 engages the inner surface of a flange on skirt 630, and is rotatable with respect thereto to provide a seal between the mounting assembly 626 and valve assembly 632. Wall 644 is also easily engageable by a user to rotate the mounting assembly 626, as described above.

Wall 640 is integrally connected at its axially outermost end to a wall 650 that extends radially outwardly there from, and terminates in a substantially axially extending wall 683. Wall 683 extends axially downstream, and connects to an axially extending wall 651 that is radially outwardly displaced from wall 683. Wall 638 is integrally connected at its axially outermost end to a wall 652 that extends radially inwardly from wall 647. Wall 652 further extends axially downstream at its radially inner edge to provide a seat for wall 651. Wall 651 is integrally connected at its axially outer edge to a cover 649 that extends substantially radially outwardly to wall 647. In particular, cover 649 has an axially inwardly extending notch disposed proximal its radially outer edge that engages the inner surface of wall 647 to secure the cover in place. Cover 649 is annular to define a centrally disposed opening that serves as outlet 664 for aerosol content, as will become more apparent from the description below.

As best seen in FIGS. 32–35, valve assembly 632 has an annular base which is defined by annular wall 650 that extends radially between walls 640 and 651. Wall 650 includes a centrally disposed barrier 641 aligned with conduit 642, having at least one aperture 637 extending there through and enables fluid (e.g. liquid/gas) to flow from the can 622 into dispenser 620.

Figure 36:
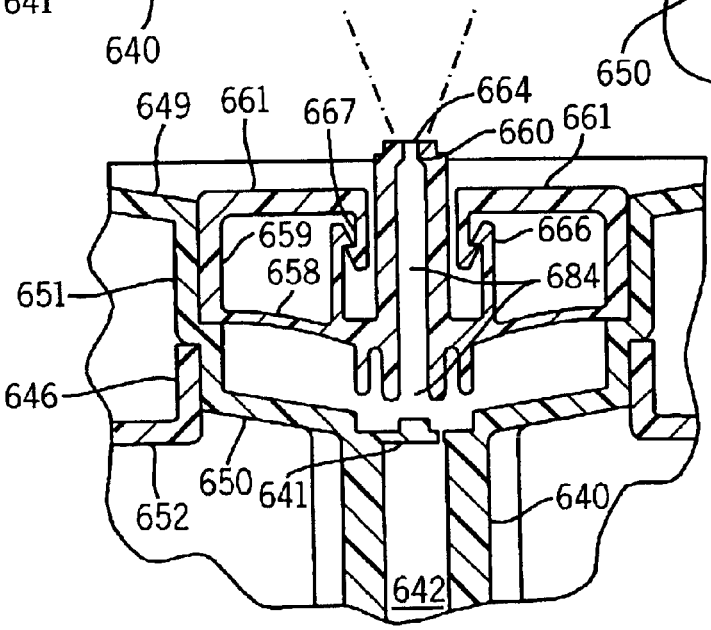
FIG. 36 is a view similar to FIG. 33, but showing the valve during the spray phase.

A flexible, mono-stable diaphragm 658 is disposed within valve assembly 632, and is movable from a first closed position (FIG. 32), to a second open position (FIG. 36) to activate the spray phase, as will be described in more detail below. Diaphragm 658 is a radially extending bow-shaped wall whose concave surface faces wall 650. The diaphragm is integrally connected at its radially outer edge to an axially extending wall 659 disposed radially inwardly of, and adjacent wall 651. Wall 659 is integrally connected at its axially outer end to a cover 661.

Diaphragm 658 further includes a radially inner, axially extending annular leg structure 662 whose radially outer surface abuts the radially inner surface of cover 661. Leg has, at its axially outer end, an outlet 664 of the dispenser 620 defined by a nozzle 660. Leg 662 is further integrally connected to diaphragm 658 proximal its axially inner end, such that an annular reservoir 680 is defined by wall 650, wall 651, diaphragm 658, and leg 662. Reservoir 680 provides an accumulation chamber that receives chemical from can 622 during the accumulation phase.

A flexible pawl 666 extends axially downstream from the radially inner edge of diaphragm 658. Cover 661 includes a pawl 667 extending axially upstream there from and slightly radially inwardly with respect to pawl 666. Both pawls 666 and 667 are barbed so as to interlock during the spray phase, as will be described in more detail below.

Figure 33:
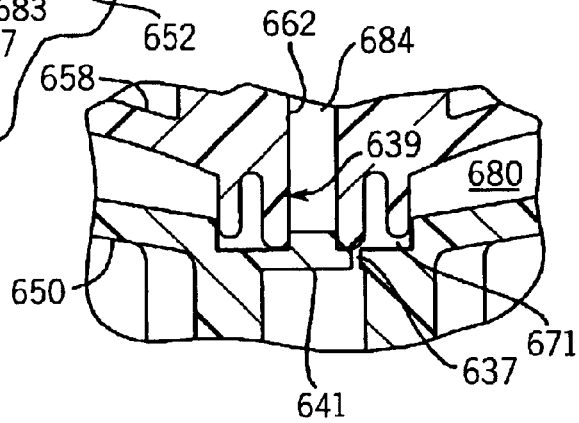
FIG. 33 is a further enlarged section view of the inlet of FIG. 32.
Figure 34:
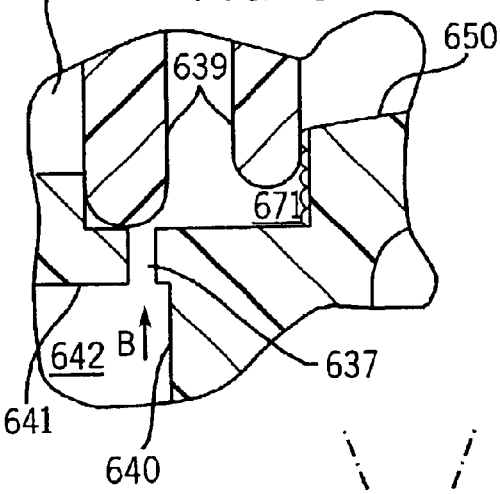
FIG. 34 is a still further enlarged sectional view of the inlet of FIG. 32.
Figure 35:
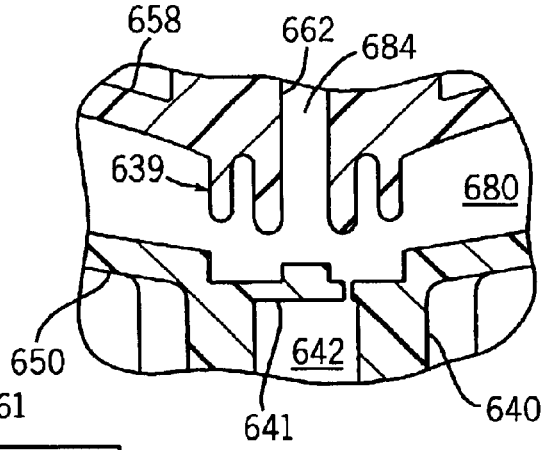
FIG. 35 is a view similar to FIG. 32, but with the valve shown during the spray phase.

Leg 662 further includes at its axially inner end an annular fork/foot 639 extending upstream there from. The inner prong of fork 639 abuts barrier 641 to form a seal therewith during the accumulation part of the cycle, while the outer prong is recessed from the inner prong, and abuts the radially textured inner surface of wall 650. Accordingly, a channel 671 (defined by aperture 637, outer prong of fork 639, and wall 650) extends from conduit 642 and allows chemical to flow into accumulation chamber 680 during the accumulation phase, as illustrated in FIGS. 33 and 34. Because the inner prong of fork 639 is sealed against the radially outer edge of barrier 641, fluid is unable to flow out of accumulation chamber during the accumulation phase.

As best illustrated in FIG. 34, the radially inner surface of wall 650 is textured to provide a timing seal that permits a slow leak to allow chemical to flow into accumulation chamber 680 from conduit 642. The textured surface thus provides flow regulation. As pressure increases due to a temperature rise in a room in which the can is stored, the forks 639 will tend to deflect outward and thus more tightly against the textured surface. This reduces the cross-sectional area of passages through the textured surface, thereby reducing flow to compensate for the increased room temperature.

The textured surface can be molded as part of the adjoining wall using the same material (e.g. polypropylene, polyethylene, etc.). Alternatively, the surface could be adhered to the wall, or the wall could even be smooth which would enable a greater flow rate into accumulation chamber 680. The textured surface could also be of an elastomeric material such as Kraton that is co-molded, or two-shot molded onto the wall.

In operation, a consumer rotates the valve assembly 632 relative to mounting assembly 626, preferably by rotating wall 644. This causes the valve assembly 632 to become displaced axially inwardly, and biases wall 640 against valve stem 625, thereby causing the aerosol contents to flow out of can 622, and beginning the accumulation phase. The aerosol contents flow through conduit 642 and into opening 637, through channel 671, and into the accumulation chamber. The rate at which the aerosol contents are able to flow through channel 682 can be regulated by the density and configuration of texture on wall 650, as well as the number of apertures extending through barrier 641.

During the accumulation phase, the constant supply of aerosol content flowing from intake channel 682 into the accumulation chamber 680 causes pressure to build therein, and such pressure acts against the underside of diaphragm 658. Once the accumulation chamber 680 is sufficiently charged with aerosol content, such that the pressure reaches a predetermined threshold, the mono-stable diaphragm 658 becomes deformed from the normal closed position illustrated in FIG. 32 to the open position illustrated in FIG. 36. This initiates the spray phase as inner prong of fork 639 no longer abuts against barrier 641.

The deformation of diaphragm 658 is resisted by the flexibility of the diaphragm. The internal pressure continues to accumulate within the accumulation chamber 680 until it exceeds the maximum pressure threshold, at which point the barbed surfaces of pawls 666 and 667 interlock when the diaphragm approaches the second configuration. This allows the diaphragm 658 to open by flexing axially outwardly from the hinge between formed between its radially outer edge and wall 659.

Leg 662 travels along with the radially inner edge of diaphragm 658 such that, when the diaphragm is open, leg 662 and fork 639 are moved downstream of barrier 641 to create an outlet channel 684 extending through leg 662, between accumulation chamber 680 and the outlet end 664 of the dispenser 620. Accordingly, during the spray phase, the stored aerosol content flows from accumulation chamber 680, along outtake channel 684, and exits the outlet end 664 of dispenser 620 into the ambient environment.

Furthermore, because the seal between inner prong of fork 639 and barrier 641 is removed during the start of the spray phase, aerosol content is able to flow from can 622 and directly out the outlet end 664, such that the output spray comprises the chemical stored in the accumulation chamber along with the chemical in the can until all chemical has been released.

During the spray phase, the pressure within the accumulation chamber immediately abates as the stored aerosol content exits the dispenser 620. However, because pawls 666 and 667 are interlocked, the dispenser 620 remains in the spray phase and enables the total release of aerosol content.

Figure 37:
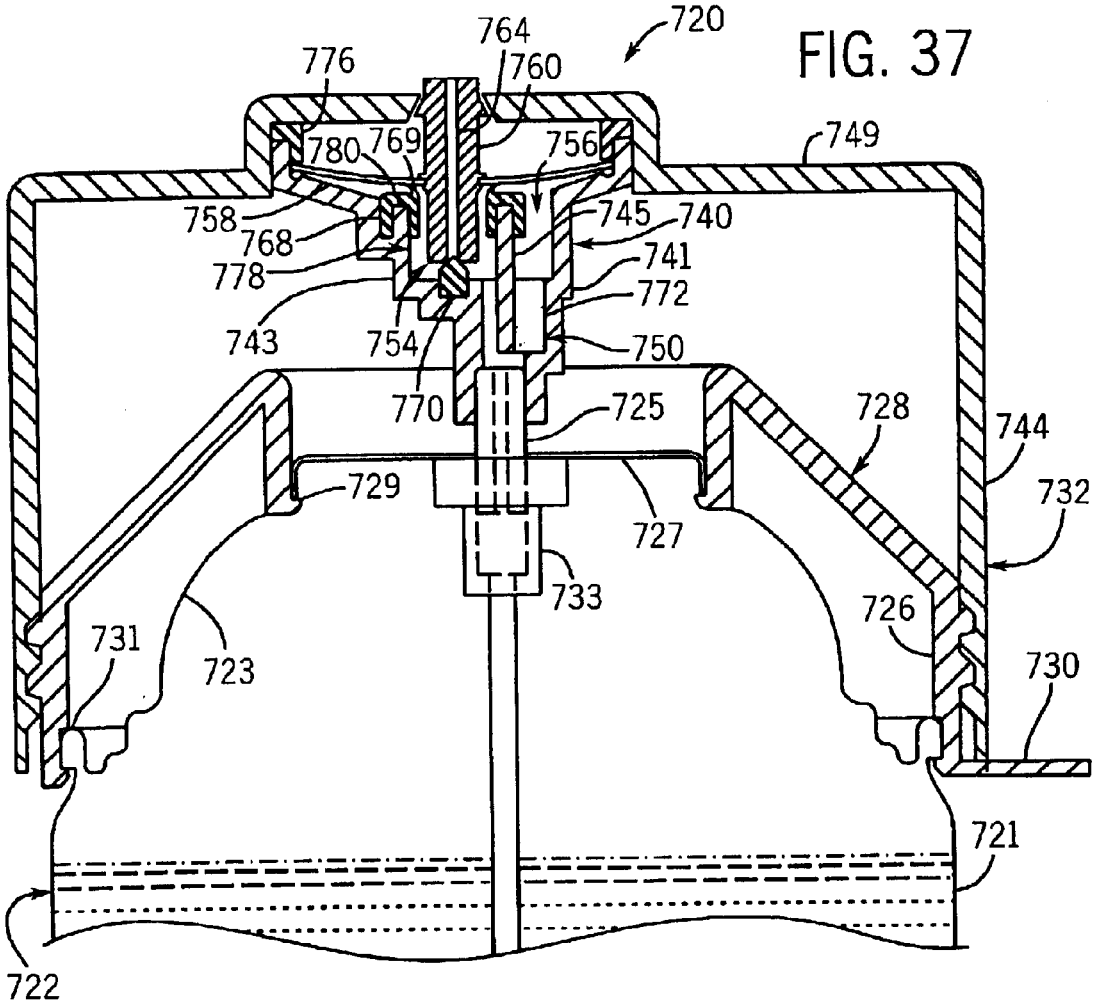
FIG. 37 is a sectional view of an automatic dispensing valve of another alternative embodiment in an "off" configuration, mounted onto an aerosol can.
Figure 39:
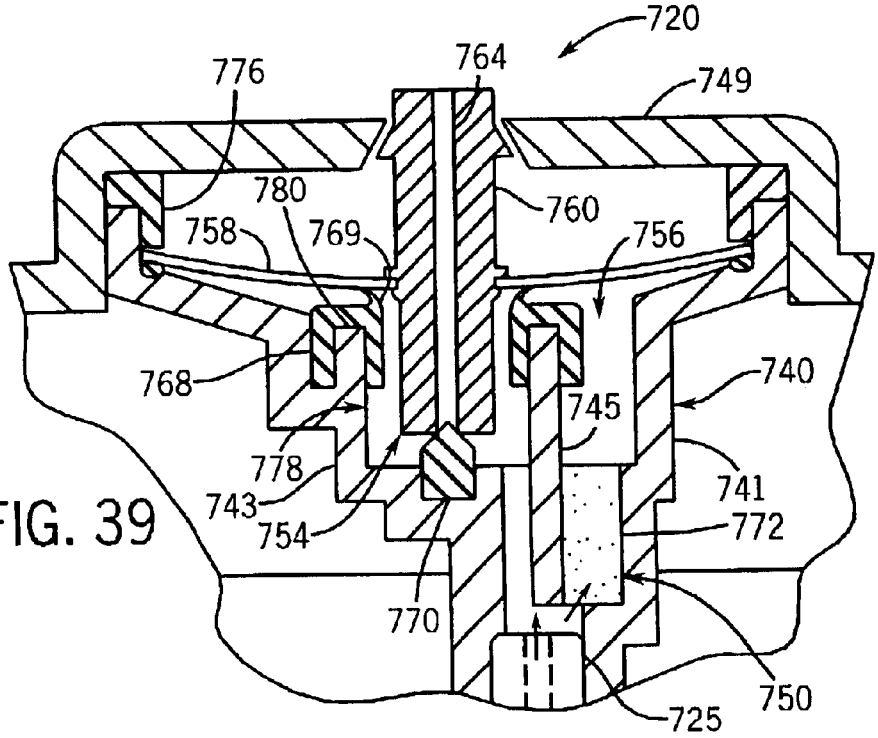
FIG. 39 is an enlarged view of a portion of the dispenser illustrated in FIG. 38.
Figure 38:
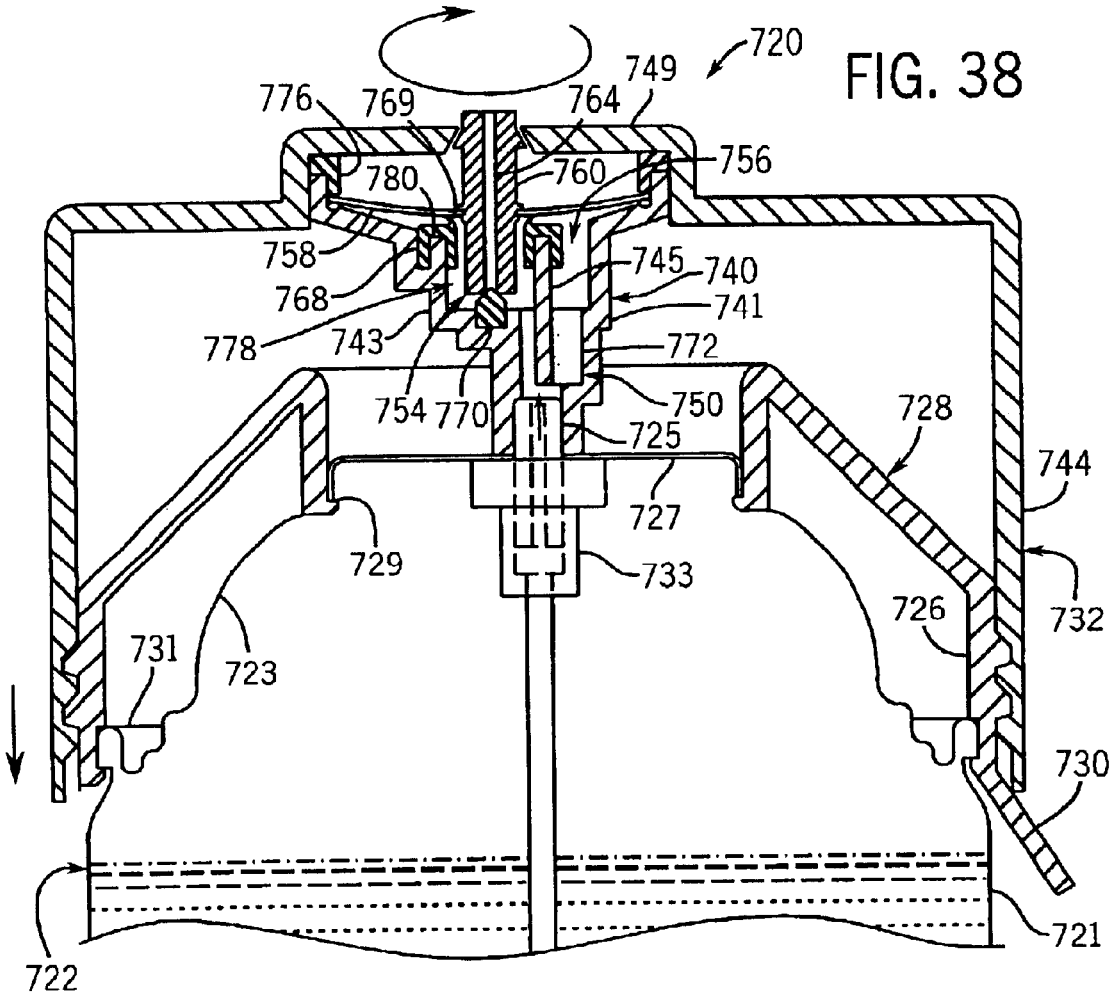
FIG. 38 is a view similar to FIG. 37, but with the valve in an "on" position.

Referring next to FIG. 37, a dispenser 720 is mounted onto an aerosol can 722 in accordance with an alternate embodiment of the invention. Dispenser 720 includes a side wall 744 that is integrally connected to cover 749. Side wall has a threaded inner surface that attaches to wall 726 in the manner described above. Valve assembly 754 includes an annular retainer wall 740 that extends outwardly from valve stem 725. A divider wall 745 extends axially within retainer 740 to define conduit 750 and a return path. Accumulated aerosol content merges with aerosol content that travels directly from the can out the dispenser during the spray phase, such that a single output spray is emitted.

Retainer wall 740 has an flange 780 that extends down and, in combination with the distal end of wall 745, supports a seal 768 having a flange 769 that engages the underside of diaphragm 758 to prevent aerosol content from escaping from the accumulation chamber 756 during the accumulation phase.

Figure 40:
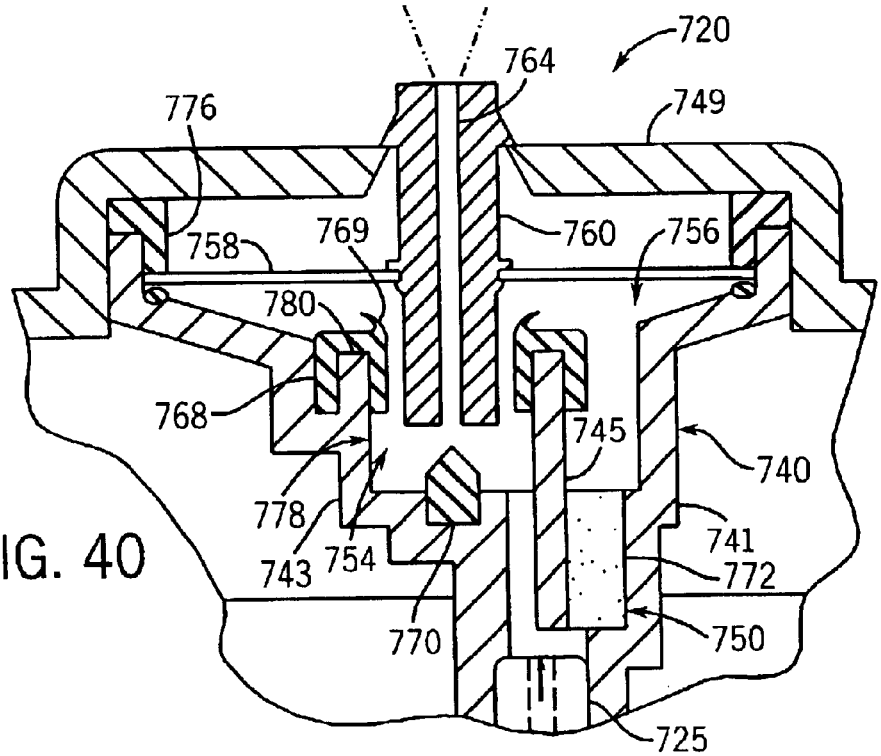
FIG. 40 is a view similar to FIG. 39, but with the valve in a spray configuration.

When the user rotates control assembly 732 relative to the can 722, the accumulation phase commences, where the axially inner end of retainer wall 740 is depressing valve stem 725 to begin the flow of aerosol content from the can 722 into the dispenser 720. Because plug 770 prevents the aerosol content from entering outlet 764, the content instead travels through the regulating porous media 772 and into the accumulation chamber 756. Once the pressure accumulating against the underside of diaphragm 758 reaches a predetermined threshold, the diaphragm deflects up, as illustrated in FIG. 40.

As the diaphragm 758 becomes deflected, wall 760 (which supports the radially inner edge of the diaphragm) is also translated up. The translation removes the interference between plug 770 and outlet 764, thereby permitting aerosol content to flow from the can 722, into outlet channel 764, and exit the dispenser 720. Furthermore, the translation of wall 764 removes diaphragm 758 from flange 769, thus permitting accumulated aerosol content to travel through channel 778, and exit the dispenser 120 via outlet 764.

Wall 760 is beveled proximal its axially outer end and radially aligned with beveled edges on the radially inner surface of cover 749. Accordingly, as wall 760 translates axially downstream when the dispenser 720 transitions from the accumulation phase to the spray phase, the cover cams over the beveled edge of wall 760 until snapping back such that the radially extending edges of the bevels interlock to prevent wall 760 from translating axially upstream once the spray phase has been initiated. Accordingly, even though the pressure within accumulation chamber 156 will abate below the threshold, diaphragm 158 will remain open due to the interlocking between the beveled edges of cover 749 and wall 760.

Figure 41:
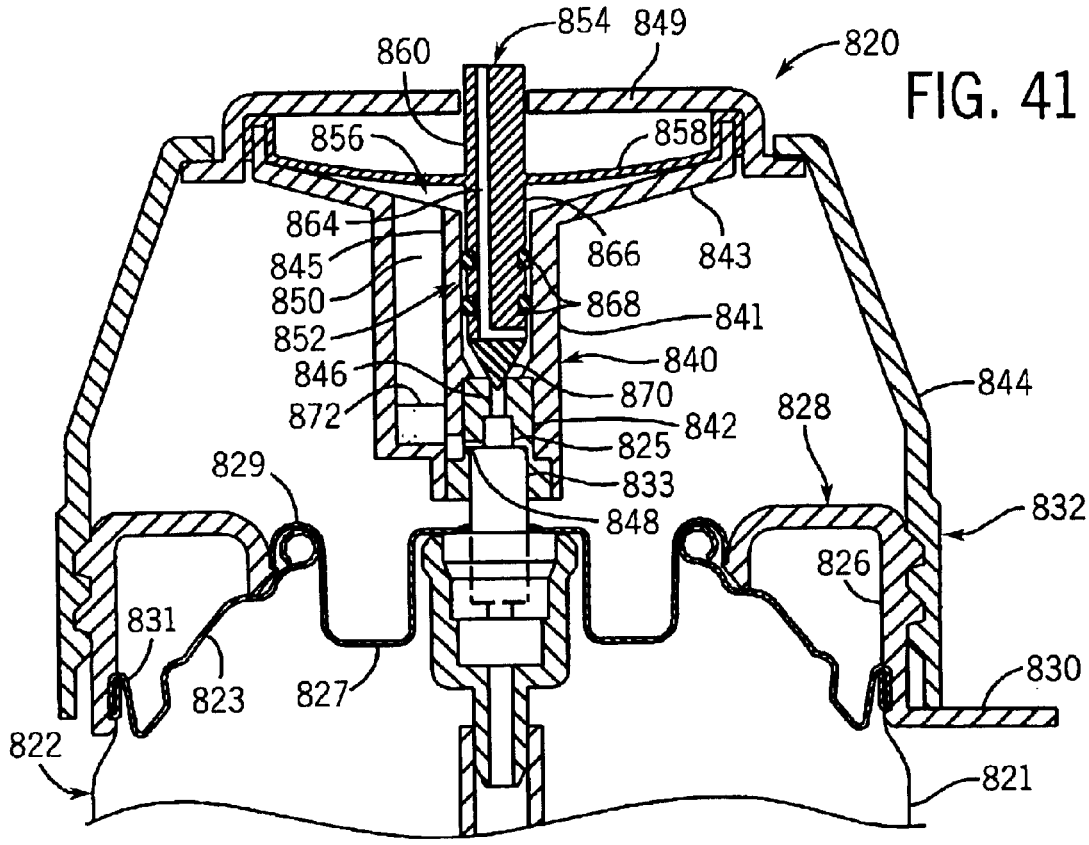
FIG. 41 is a sectional view of an automatic dispensing valve of an alternate embodiment in an "off" configuration, mounted onto an aerosol can.

Referring now to FIG. 41, an aerosol can 822 in accordance with another embodiment includes a cylindrical wall 821 that is closed at its upper margin by the usual dome 823. The upper margin of the can wall 821 is joined to the dome 823 via can chime 831. An upwardly open cup 827 is located at the center of the dome 823 and is joined to the dome by rim 829.

Conventional valve 833 is located at the center of the valve cup 827. The valve 833 has an upwardly extending valve stem 825, through which the contents of the can may be expelled. Valve 833 is shown as a vertically actuable valve, which can be opened by moving the valve stem 825 directly downwardly. Instead, one could use a side-tilt valve where the valve is actuated by tipping the valve stem laterally and somewhat downwardly.

A dispenser, generally 820, is configured for engagement with the vertically actuated type valve 833. The dispenser 820 is mostly polypropylene, albeit other suitable materials can be used.

The dispenser 820 includes a control assembly 832 having a side wall 844 that extends substantially axially upstream from a cover 849, and terminates with a threaded radially inner surface. It should be appreciated that throughout this description, the terms "axially outer, axially downstream, axially inner, axially upstream" are used with reference to the longitudinal axis of the container. The term "radial" refers to a direction outward or inward from that axis. Control assembly 832 further includes an inner mounting structure 828 having a pair of axially extending walls that engage the radially outer surfaces of rim 829 and chime 831 to fasten the structure 828 in place. The radially outer wall 826 of structure 828 has threads on its outer surface that engage the threads of side wall 844.

Figure 42:
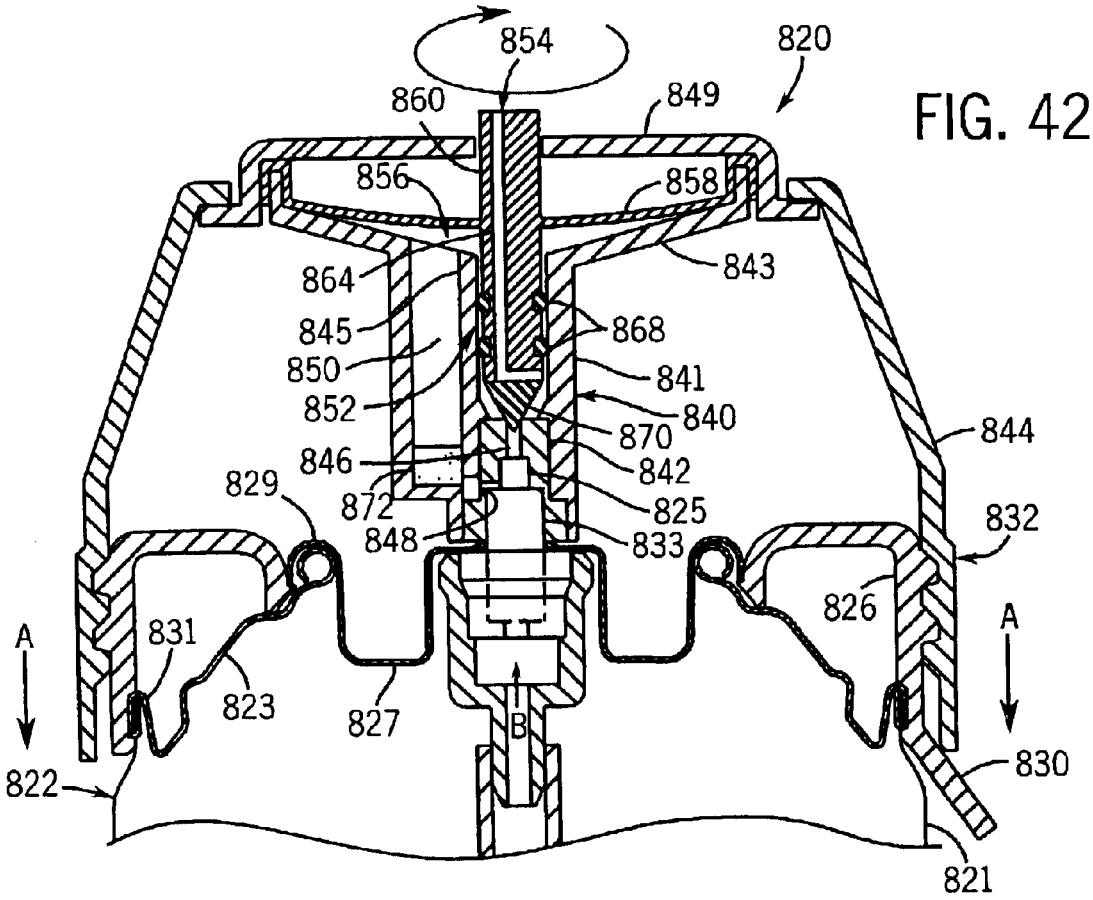
FIG. 42 is a view similar to FIG. 41, but with the valve in an "on" position.

The threads have a predetermined pitch such that as the assembly 832 is rotated clockwise with respect to the mounting structure 828, it is displaced axially downwardly with respect to aerosol can 822, as illustrated in FIG. 42. In operation, therefore, a user rotates wall 844 to force the dispenser 820 downwardly along wall 826. Control assembly 832 may be further rotated to turn the dispenser 820 "ON" and "OFF."

Mounting structure 828 further includes a bar 830 that extends radially outwardly from the distal end of wall 826. Bar 830 is joined to wall 826 via a perforated tab (not shown) that is broken as the dispenser is mounted onto the can 822, thereby deflecting the tab 830 axially down to indicate that the dispenser 820 may have been tampered with (e.g., on a retail shelf).

There is an annular retainer wall 840 having an axial component 841 that extends downstream from valve 833, and a radial component 843 that extends outwardly near the radially outer end of cover 849. Wall 840 defines an axially extending centrally disposed void 852.

When the dispenser is initially mounted onto aerosol can 822, the bottom edge of wall 840 is located adjacent and radially aligned with the valve stem 825. However, it is not pressing down on stem 825.

When the valve 833 is not yet activated, the control assembly 832 has not yet engaged the aerosol can 822, and the assembly is in a storage/shipment position. However, as the control assembly 832 is rotated to displace the dispenser 820 downward (see FIG. 42), the valve stem 825 is depressed, thereby allowing the aerosol content to flow from the can 822 into the dispenser 820.

Void 852 further houses, at its bottom, a valve actuator 842 that abuts the valve stem 825. Valve actuator 842 defines a centrally disposed first entry channel 846 that extends axially up from, and aligned with, valve stem 825. Actuator 842 further defines a second entry channel 848 that extends radially outwardly from valve stem 825 to an accumulation conduit 850. Second entry channel 848 provides an outlet for aerosol content during the accumulation phase.

Valve stem 825 includes two apertures (not shown) for expelling aerosol content into the dispenser. One aperture directs content axially outwardly from the valve 833 into the first entry channel 846. A second aperture extends radially outwardly and is aligned with second entry channel 848.

Accumulation chamber 856 is partially defined by a flexible, mono-stable diaphragm 858 that is movable from a first closed position (FIG. 43), to a second open position (FIG. 44) to activate the dispenser 820. Diaphragm 858 is connected, at its radially outer end, to stationary wall 843. Diaphragm 858 is connected, at its radially inner end, to an axially extending annular wall 860 that is displaceable in the axial direction. Wall 860 defines a path 864 that is linked to the can. A pair of o-rings 868 is disposed between the outer surface of wall 860 and the inner surface of wall 840. The axially inner end of wall 860 defines a plug 870 that is operable to block channel 846.

In operation, a consumer rotates the control assembly 832 relative to can 822, preferably by rotating wall 844. This causes the valve assembly 854 to become displaced axially downwardly, and biases wall 842 against valve stem 825. This causes the aerosol contents to begin to flow out of can 822. As is evident from FIG. 43, the aerosol contents will tend to flow both axially and radially out from valve stem 825. However, because plug 870 is blocking channel 846 at this point, all aerosol content is at first forced radially through channel 848 and into accumulation conduit 850.

The mouth of conduit 850 is occupied by a porous gasket 872 that regulates the rate at which the aerosol contents are able to flow through the conduit. The constant supply of aerosol content causes pressure to build, and such pressure acts against the underside of diaphragm 858.

Figure 43:
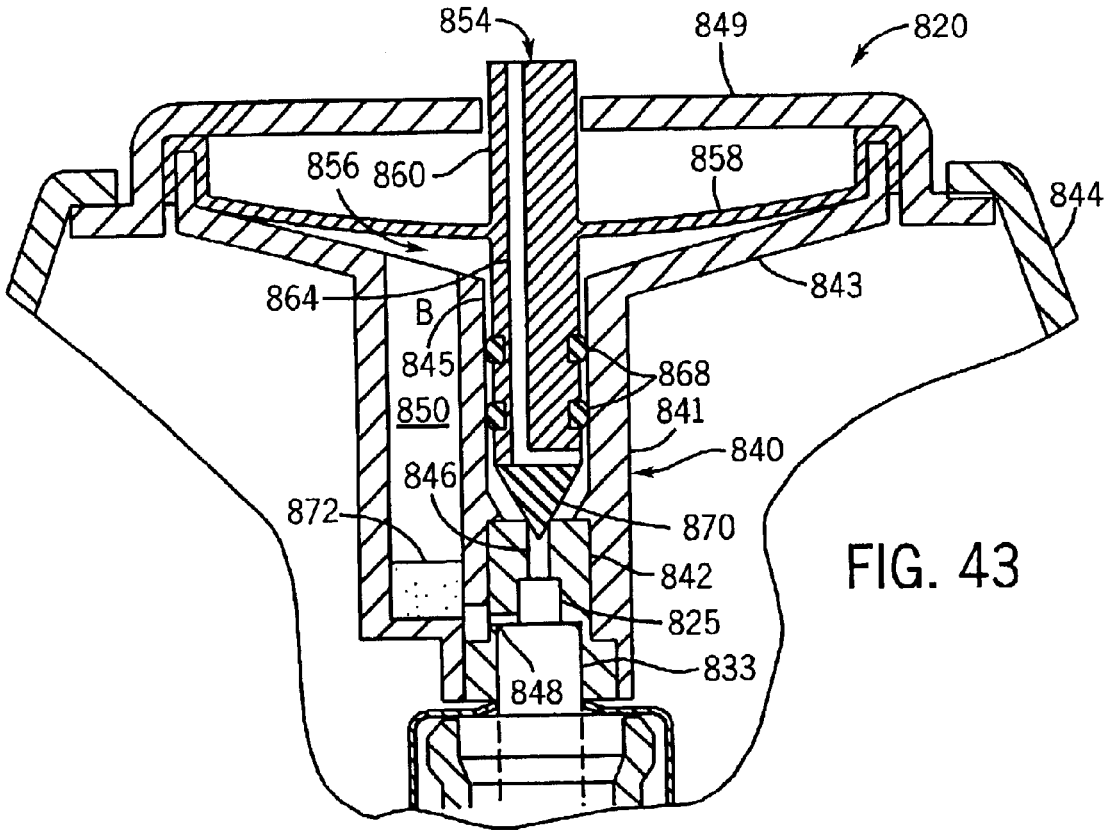
FIG. 43 is an enlarged view of a portion of the dispenser illustrated in FIG. 42.
Figure 44:
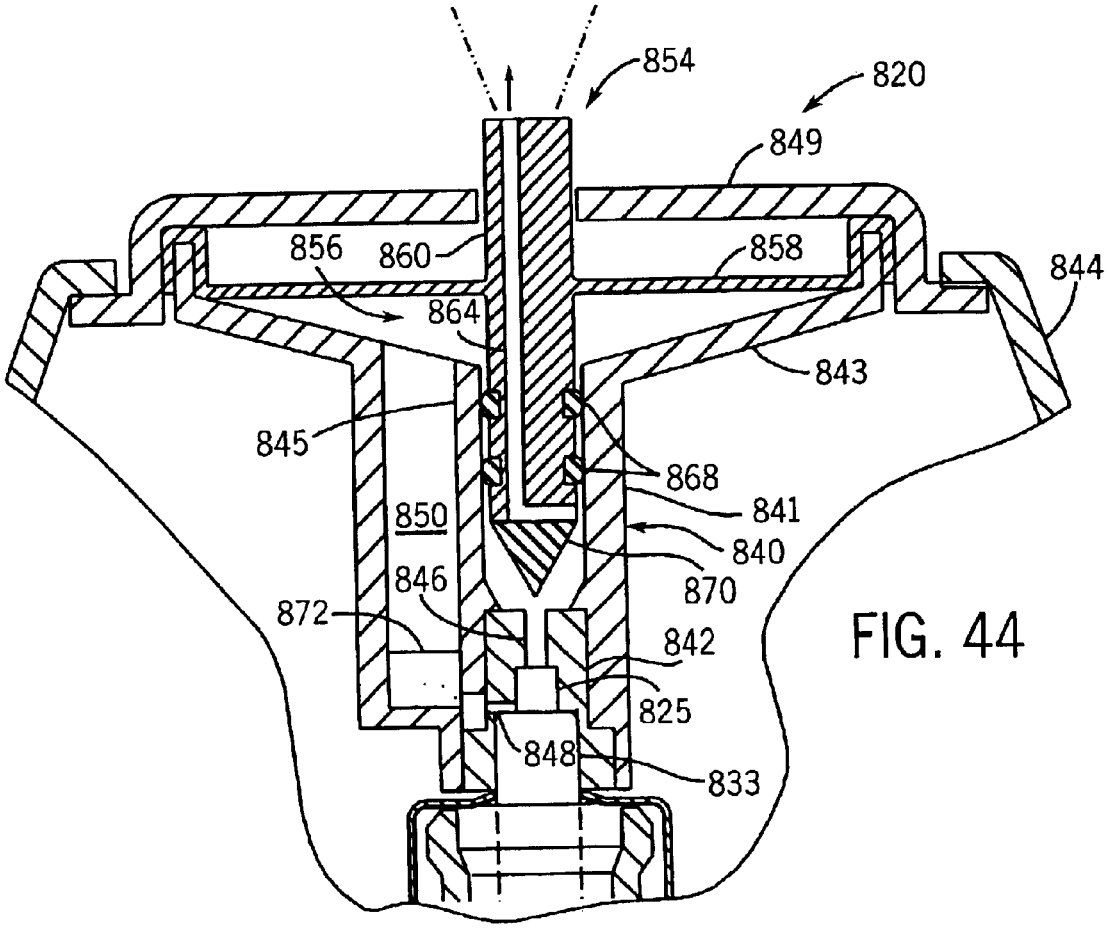
FIG. 44 is a view similar to FIG. 43, but with the valve in a spray configuration.

Once the accumulation chamber 856 is sufficiently charged with aerosol content, such that the pressure reaches a predetermined threshold, the mono-stable diaphragm 858 becomes deformed from the normal position illustrated in FIG. 43 to the position illustrated in FIG. 44. This initiates the spray phase.

As diaphragm 858 flexes up, wall 860 also is translated up, thereby removing the plug 870 from channel 846.

Accordingly, aerosol content can flow up from valve stem 825, around plug 870, and into path 864. The aerosol content exits dispenser 820 at the distal end of path 864.

The o-rings 868 prevent aerosol content from flowing from accumulation chamber 856 into channel 864 during the spray phase. Because the pressure within the accumulation chamber 856 will therefore not fall to a level less than the threshold, the dispenser will remain in the spray configuration and totally release the active chemical from can 822.

It should be appreciated that dispenser 820 could include any suitable locking mechanism as described above to mechanically lock the dispenser in the spray phase once the pressure within accumulation chamber 856 has exceeded the minimum threshold.

The above description has been that of preferred embodiments of the present invention. It will occur to those that practice the art, however, that many modifications may be made without departing from the spirit and scope of the invention. In order to advise the public of the various embodiments that may fall within the scope of the invention, the following claims are made.

INDUSTRIAL APPLICABILITY

The present invention provides automated dispenser assemblies for dispensing aerosol can contents in a single burst without the use of electric power or repeated or continuous manual activation.

What is claimed is:

1. A valve assembly that is suitable to dispense a chemical from an aerosol container, the valve assembly being of the type that can automatically release active chemical from the container, the valve assembly comprising:

a housing mountable on an aerosol container;

a movable diaphragm associated with the housing and linked to a seal, the diaphragm being biased towards a first configuration;

an accumulation chamber inside the housing for receiving chemical from the container and providing variable pressure against the diaphragm;

a first passageway linking the aerosol container with an outlet of the valve assembly;

a second passageway linking the container with the accumulation chamber;

whereby when the diaphragm is in the first configuration the seal restricts the flow of the active chemical out of the valve assembly via the passageway; and whereby when the pressure inside the accumulation chamber exceeds a specified threshold the diaphragm can move to a second configuration where active chemical is permitted to spray from the valve assembly;

wherein once the diaphragm has moved from the first configuration to the second configuration it will automatically stay out of the first configuration until at least a majority of the active chemical in the container has been released.

2. The valve assembly as recited in claim 1, wherein a porous material is disposed within the first passageway to regulate the flow rate of fluid there through.

3. The valve assembly as recited in claim 1, further comprising a latch linked to the diaphragm that engages when the diaphragm is in the second configuration to inhibit the seal from moving back to a position blocking the first passageway.

4. The valve assembly as recited in claim 1, wherein the seal is displaceable in an axial direction.

5. The valve assembly as recited in claim 1, wherein pressure in the accumulation chamber is inhibited from abating when the diaphragm is in the second configuration.

6. The valve assembly as recited in claim 1, wherein the second passageway delivers gas propellant from the container to the accumulation chamber.

7. The valve assembly as recited in claim 1, further comprising an actuator portion of the housing that rotates to allow gas propellant to leave the container and enter the second passageway.

8. The valve assembly as recited in claim 1, wherein the active chemical is selected from the group consisting of insect repellents, insecticides, fragrances, sanitizers, and deodorizers.

9. The valve assembly as recited in claim 1, further comprising a second seal preventing chemical from exiting the dispenser from the accumulation chamber when the diaphragm is in the second configuration.

10. A method of automatically delivering an active chemical from an aerosol container to an ambient environment, the method comprising the steps of:

(a) providing a valve assembly that is suitable to dispense a chemical from an aerosol container, the valve assembly being of the type that can automatically release active chemical from the container, the valve assembly comprising:

(i) a housing mountable on an aerosol container;

(ii) a movable diaphragm associated with the housing and linked to a seal, the diaphragm being biased towards a first configuration;

(iii) an accumulation chamber inside the housing for receiving chemical from the container and providing variable pressure against the diaphragm;

(iv) a first passageway linking the aerosol container with an outlet of the valve assembly, whereby when the diaphragm is in the first configuration the seal restricts the flow of the active chemical out of the valve assembly via the passageway, and whereby when the pressure inside the accumulation chamber exceeds a specified threshold the diaphragm can move to a second configuration where active chemical is permitted to spray from the valve assembly;

(v) a second passageway linking the container with the accumulation chamber;

(vi) wherein once the diaphragm has moved from the first configuration to the second configuration it will automatically stay out of the first configuration until at least a majority of the active chemical in the container has been released;

(b) mounting the valve assembly to such an aerosol container; and;

(c) actuating the valve assembly.

11. The method as recited in claim 10, wherein the second passageway delivers gas propellant from the container to the accumulation chamber.

12. A valve assembly that is suitable to dispense a chemical from an aerosol container, the valve assembly being of the type that can automatically release active chemical from the container, the valve assembly comprising:

a housing mountable on an aerosol container;

a movable diaphragm associated with the housing and linked to a seal, the diaphragm being biased towards a first configuration;

an accumulation chamber inside the housing for receiving chemical from the container and providing variable pressure against the diaphragm;

a passageway linking the aerosol container with an outlet of the valve assembly;

a latch linked to the diaphragm that engages when the diaphragm is in the second configuration to inhibit the seal from moving back to a position blocking the passageway;

whereby when the diaphragm is in the first configuration the seal restricts the flow of the active chemical out of the valve assembly via the passageway; and whereby when the pressure inside the accumulation chamber exceeds a specified threshold the diaphragm can move to a second configuration where active chemical is permitted to spray from the valve assembly;

wherein once the diaphragm has moved from the first configuration to the second configuration it will automatically stay out of the first configuration until at least a majority of the active chemical in the container has been released.

13. The valve assembly as recited in claim 12, wherein a porous material is disposed within the passageway to regulate the flow rate of fluid there through.

14. The valve assembly as recited in claim 12, wherein the seal is displaceable in an axial direction.

15. The valve assembly as recited in claim 12, wherein pressure in the accumulation chamber is inhibited from abating when the diaphragm is in the second configuration.

16. The valve assembly as recited in claim 12, further comprising a second passageway linking the container with the accumulation chamber.

17. The valve assembly as recited in claim 16, wherein the second passageway delivers gas propellant from the container to the accumulation chamber.

18. The valve assembly as recited in claim 16, further comprising an actuator portion of the housing that rotates to allow gas propellant to leave the container and enter the second passageway.

19. The valve assembly as recited in claim 12, wherein the active chemical is selected from the group consisting of insect repellents, insecticides, fragrances, sanitizers, and deodorizers.

20. The valve assembly as recited in claim 12, further comprising a second seal preventing chemical exiting the dispenser from the accumulation chamber during the when the diaphragm is in the second configuration.

21. A method of automatically delivering an active chemical from an aerosol container to an ambient environment, the method comprising steps of:

(a) providing a valve assembly that is suitable to dispense a chemical from an aerosol container, the valve assembly being of the type that can automatically release active chemical from the container, the valve assembly comprising:

(i) a housing mountable on an aerosol container;

(ii) a movable diaphragm associated with the housing and linked to a seal, the diaphragm being biased towards a first configuration;

(iii) an accumulation chamber inside the housing for receiving chemical from the container and providing variable pressure against the diaphragm;

(iv) a passageway linking the aerosol container with an outlet of the valve assembly, whereby when the diaphragm is in the first configuration the seal restricts the flow of the active chemical out of the valve assembly via the passageway, and whereby when the pressure inside the accumulation chamber exceeds a specified threshold the diaphragm can move to a second configuration where active chemical is permitted to spray from the valve assembly;

(v) a latch linked to the diaphragm that engages when the diaphragm is in the second configuration to inhibit the seal from moving back to a position blocking the passageway;

(vi) wherein once the diaphragm has moved from the first configuration to the second configuration it will automatically stay out of the first configuration until at least a majority of the active chemical in the container has been released;

(b) mounting the valve assembly to such an aerosol container; and;

(c) actuating the valve assembly.

* * * * *